US011132946B2

(12) United States Patent
Yang et al.

(10) Patent No.: US 11,132,946 B2
(45) Date of Patent: Sep. 28, 2021

(54) EMISSION SIGNAL DRIVER AND DISPLAY DEVICE INCLUDING THE SAME

(71) Applicants: Samsung Display Co., LTD., Yongin-si (KR); Konkuk University Industrial Cooperation Corp, Seoul (KR)

(72) Inventors: Tae Hoon Yang, Yongin-si (KR); Joon Ho Lee, Seongnam-si (KR); Kee Chan Park, Seoul (KR); Ki Bum Kim, Seoul (KR); Jong Chan Lee, Suwon-si (KR); Woong Hee Jeong, Seoul (KR)

(73) Assignees: SAMSUNG DISPLAY CO., LTD., Gyeonggi-Do (KR); KONKUK UNIVERSITY INDUSTRIAL COOPERATION CORP, Seoul (KR)

( * ) Notice: Subject to any disclaimer, the term of this patent is extended or adjusted under 35 U.S.C. 154(b) by 0 days.

(21) Appl. No.: 16/876,910

(22) Filed: May 18, 2020

(65) Prior Publication Data

US 2021/0012708 A1 Jan. 14, 2021

(30) Foreign Application Priority Data

Jul. 12, 2019 (KR) ..... 10-2019-0084283

(51) Int. Cl.

| | |
|---|---|
| ***G09G 3/32*** | (2016.01) |
| ***G09G 3/20*** | (2006.01) |
| ***G09G 3/3225*** | (2016.01) |

(52) U.S. Cl.
CPC ... *G09G 3/3225* (2013.01); *G09G 2300/0426* (2013.01); *G09G 2310/08* (2013.01)

(58) Field of Classification Search
None
See application file for complete search history.

(56) References Cited

U.S. PATENT DOCUMENTS

2008/0180356 A1* 7/2008 Minami ..... G09G 3/3233 345/55
2015/0294619 A1* 10/2015 Lee ..... G09G 3/3266 345/77

FOREIGN PATENT DOCUMENTS

KR 101881853 B1 7/2018

* cited by examiner

*Primary Examiner* — Carl Adams
(74) *Attorney, Agent, or Firm* — Cantor Colburn LLP

(57) ABSTRACT

An emission signal driver comprises stages connected to emission lines. Each of the stages includes a node controller which supplies a start signal or a carry signal, which is input to a start terminal, to a first node in response to a clock signal input to a clock terminal, a first inverter connected between the first node and a second node, and a second inverter connected between the second node and an output terminal.

19 Claims, 25 Drawing Sheets

EMISSION SIGNAL DRIVER AND DISPLAY DEVICE INCLUDING THE SAME

This application claims priority to Korean Patent Application No. 10-2019-0084283 filed on Jul. 12, 2019, and all the benefits accruing therefrom under 35 U.S.C. § 119, the content of which in its entirety is herein incorporated by reference.

BACKGROUND

1. Field

The disclosure relates to an emission signal driver and a display device including the emission signal driver.

2. Description of the Related Art

As the information society develops, demands for display devices for displaying images are increasing in various forms. Such display devices are applied to various electronic devices such as smart phones, digital cameras, notebook computers, navigations, and smart televisions, for example. The display device may be a flat panel display device such as a liquid crystal display device, a field emission display device, and an organic light emitting display device. In an organic light emitting display device among the flat panel display devices, pixels of display panels include light emitting elements capable of emitting light by themselves, such that the organic light emitting display devices may display images without backlight units which provide light to the display panels.

Each of the pixels of the organic light emitting display devices may include a light emitting element, a driving transistor which controls an amount of a driving current supplied to the light emitting element through a first driving voltage line in response to a voltage of a gate electrode thereof, and a light emitting control transistor which controls connection between the driving transistor and the light emitting element.

SUMMARY

Embodiments of the disclosure provide an emission signal driver for outputting an emission signal applied to a gate electrode of a light emitting control transistor of each pixel.

Embodiments of the disclosure also provide a display device including the emission signal driver for outputting an emission signal applied to a gate electrode of a light emitting control transistor of each pixel.

According to an embodiment of the disclosure, an emission signal driver includes stages connected to emission lines. In such an embodiment, each of the stages includes a node controller which supplies a start signal or a carry signal, which is input to a start terminal, to a first node in response to a clock signal input to a clock terminal, a first inverter connected between the first node and a second node, and a second inverter connected between the second node and an output terminal.

In an embodiment, the first inverter may include: a first transistor which supplies a gate high voltage to the second node in a case in which the first node has a gate low voltage; and a second transistor which supplies the gate low voltage to the second node in a case in which the first node has the gate high voltage.

In an embodiment, a gate electrode of the first transistor of the first inverter may be connected to the first node, a first electrode of the first transistor of the first inverter may be connected to a gate high voltage line through which the gate high voltage is supplied, and a second electrode of the first transistor of the first inverter may be connected to the second node. In such an embodiment, a gate electrode of the second transistor of the first inverter may be connected to the first node, a first electrode of the second transistor of the first inverter may be connected to a gate low voltage line through which the gate low voltage is supplied, and a second electrode of the second transistor of the first inverter may be connected to the second node.

In an embodiment, the second inverter may include: a first transistor which supplies a gate high voltage to the output terminal in a case in which the second node has a gate low voltage; and a second transistor which supplies the gate low voltage to the output terminal in a case in which the second node has the gate high voltage.

In an embodiment, a gate electrode of the first transistor of the second inverter may be connected to the second node, a first electrode of the first transistor of the second inverter is connected to a gate high voltage line through which the gate high voltage may be supplied, and a second electrode of the first transistor of the second inverter may be connected to the output terminal. In such an embodiment, a gate electrode of the second transistor of the second inverter may be connected to the second node, a first electrode of the second transistor of the second inverter may be connected to a gate low voltage line through which the gate low voltage is supplied, and a second electrode of the second transistor of the second inverter may be connected to the output terminal.

In an embodiment, each of the stages may include a third inverter connected between the second node and a carry signal terminal.

In an embodiment, the third inverter may include: a first transistor which supplies a gate high voltage to the carry signal terminal in a case in which the second node has a gate low voltage; and a second transistor which supplies the gate low voltage to the carry signal terminal in a case in which the second node has the gate high voltage.

In an embodiment, a gate electrode of the first transistor of the third inverter may be connected to the second node, a first electrode of the first transistor of the third inverter may be connected to a gate high voltage line through which the gate high voltage is supplied, and a second electrode of the first transistor of the third inverter may be connected to the carry signal terminal. In such an embodiment, a gate electrode of the second transistor of the third inverter may be connected to the second node, a first electrode of the second transistor of the third inverter may be connected to a gate low voltage line through which the gate low voltage is supplied, and a second electrode of the second transistor of the third inverter may be connected to the carry signal terminal.

In an embodiment, each of the stages may include a capacitor connected between the first node and a first driving voltage line.

In an embodiment, the node controller of the $k^{th}$ stage among the stages may include a first node control transistor which supplies the start signal or the carry signal to the first node in a case in which the clock signal has a gate high voltage, where k is a positive integer.

In an embodiment, a gate electrode of the first node control transistor may be connected to the clock terminal, a first electrode of the first node control transistor may be connected to the first node, and a second electrode of the first node control transistor may be connected to the start terminal.

In an embodiment, the node controller of the $(k+1)^{th}$ stage among the stages may include a second node control transistor which supplies the start signal or the carry signal to the first node in a case in which the clock signal has a gate low voltage.

In an embodiment, a gate electrode of the second node control transistor may be connected to the clock terminal, a first electrode of the second node control transistor may be connected to the start terminal, and a second electrode of the second node control transistor may be connected to the first node.

In an embodiment, the node controller of the $k^{th}$ stage among the stages may include a first node control transistor which supplies the start signal or the carry signal to the first node in a case in which the clock signal has a gate low voltage, where k is a positive integer.

In an embodiment, the $k^{th}$ stage may further include a third inverter connected between the first node control transistor and the clock terminal.

In an embodiment, a gate electrode of the first node control transistor may be connected to the third inverter, a first electrode of the first node control transistor may be connected to the start terminal, and a second electrode of the first node control transistor may be connected to the first node.

In an embodiment, the third inverter may include: a first transistor which supplies a gate high voltage to the gate electrode of the first node control transistor in the case in which the clock signal has the gate low voltage; and a second transistor which supplies the gate low voltage to the gate electrode of the first node control transistor in a case in which the clock signal has the gate high voltage.

In an embodiment, a gate electrode of the first transistor of the third inverter may be connected to the clock terminal, a first electrode of the first transistor of the third inverter may be connected to a gate high voltage line through which the gate high voltage is supplied, a second electrode of the first transistor of the third inverter may be connected to the gate electrode of the first node control transistor. In such an embodiment, a gate electrode of the second transistor of the third inverter may be connected to the clock terminal, a first electrode of the second transistor of the third inverter may be connected to a gate low voltage line through which the gate low voltage is supplied, and a second electrode of the second transistor of the third inverter may be connected to the gate electrode of the first node control transistor.

In an embodiment, the node controller of the $(k+1)^{th}$ stage among the stages may include a second node control transistor which supplies the start signal or the carry signal to the first node in a case in which the clock signal has a gate high voltage.

According to an embodiment of the disclosure, a display device includes: pixels connected to emission lines; and an emission signal driver including stages connected to the emission lines. In such an embodiment, each of the stages includes a node controller which supplies a start signal or a carry signal, which is input to a start terminal, to a first node in response to a clock signal input to a clock terminal, a first inverter connected between the first node and a second node, and a second inverter connected between the second node and an output terminal.

BRIEF DESCRIPTION OF THE DRAWINGS

These and/or other features of the invention will become apparent and more readily appreciated from the following description of the embodiments, taken in conjunction with the accompanying drawings, in which.

DETAILED DESCRIPTION

Figure 1:
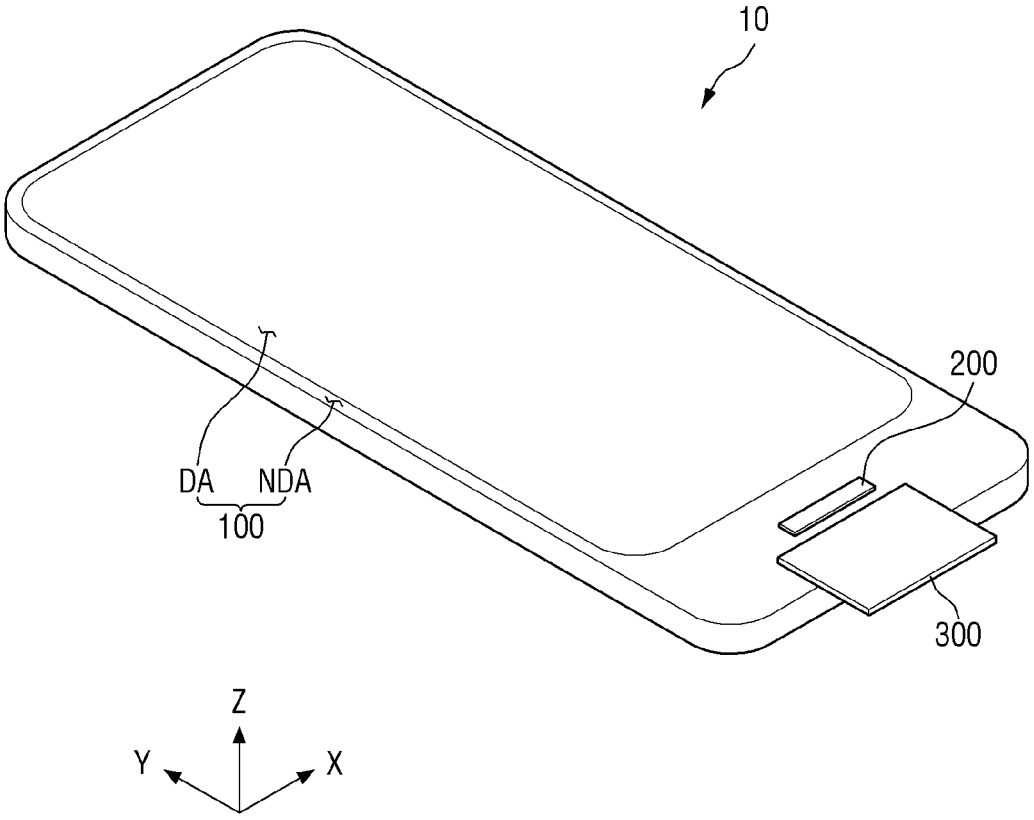
FIG. 1 is a perspective view illustrating a display device according to an embodiment.

The invention will now be described more fully hereinafter with reference to the accompanying drawings, in which preferred embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. The same reference numbers indicate the same components throughout the specification. In the attached figures, the thickness of layers and regions is exaggerated for clarity.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

It will also be understood that when a layer is referred to as being "on" another layer or substrate, it can be directly on the other layer or substrate, or intervening layers may also be present. In contrast, when an element is referred to as being "directly on" another element, there are no intervening elements present.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." "At least one of A and B" means "A and/or B." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system).

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

Hereinafter, embodiments of the invention will be described with reference to the accompanying drawings.

Figure 2:
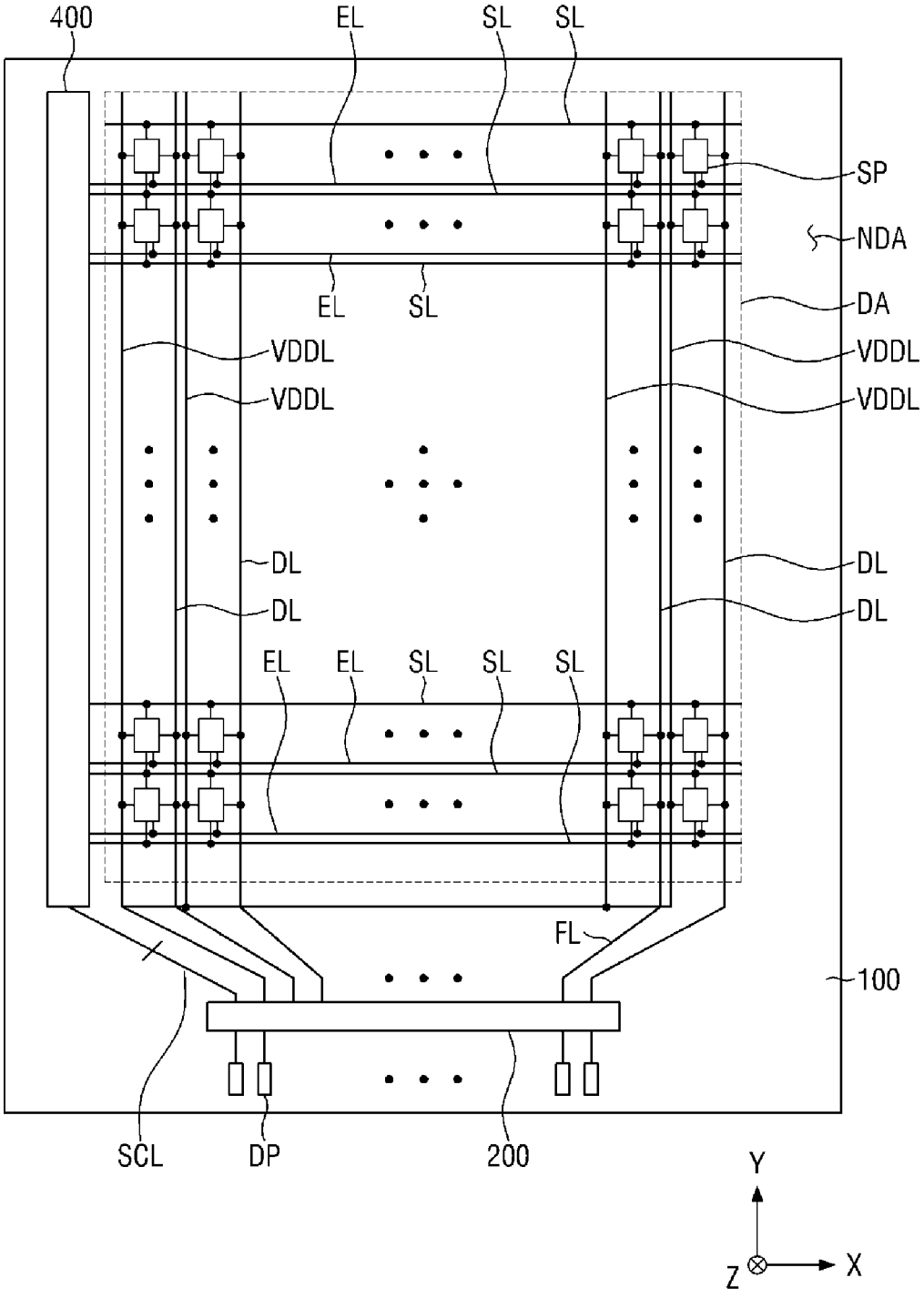
FIG. 2 is a plan view illustrating the display device according to one embodiment.
Figure 3:
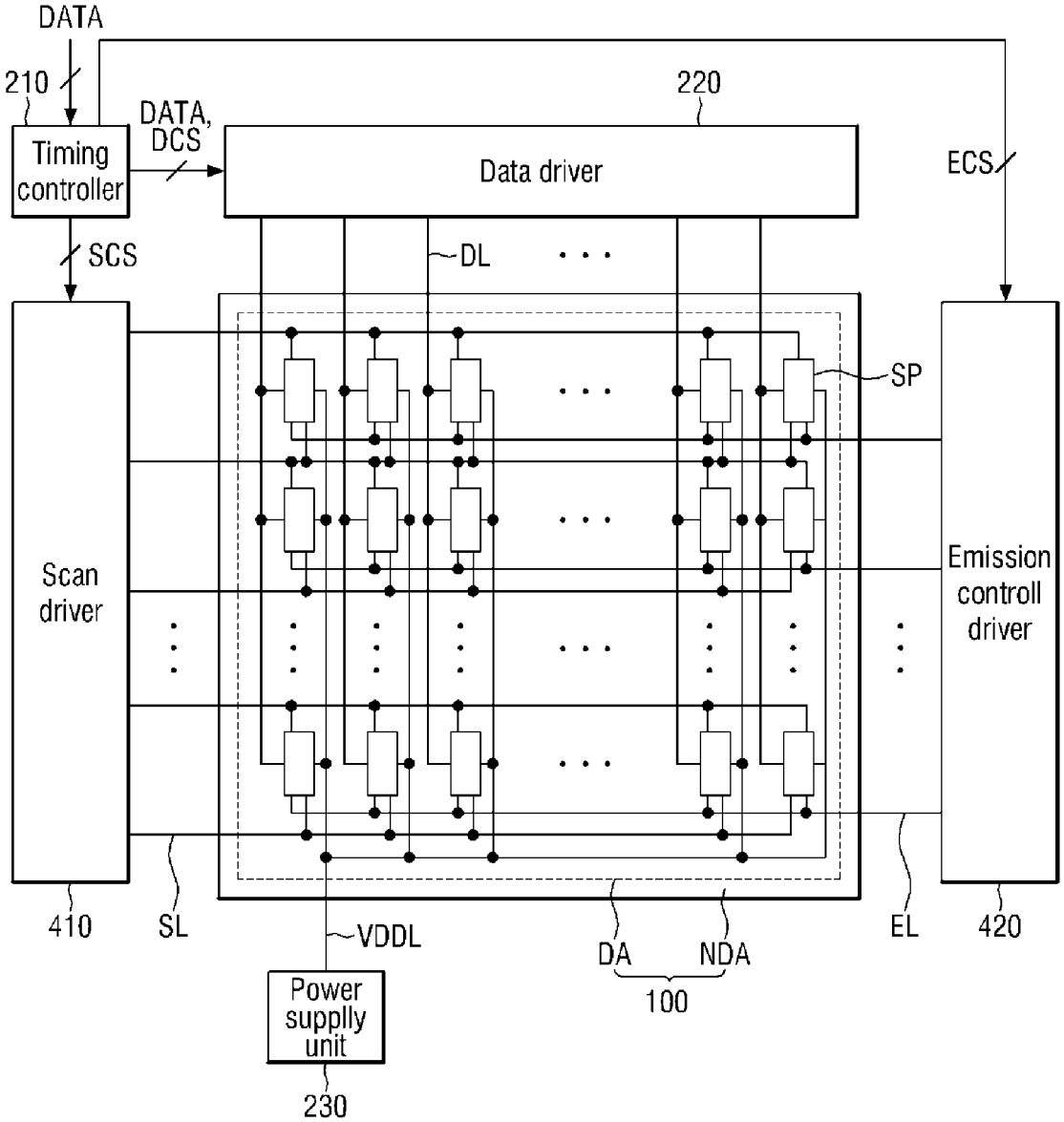
FIG. 3 is a block diagram illustrating the display device according to an embodiment.

FIG. 1 is a perspective view illustrating a display device according to an embodiment. FIG. 2 is a plan view illustrating the display device according to an embodiment. FIG. 3 is a block diagram illustrating the display device according to an embodiment;

Herein, "upper portion," "top," and "upper surface" denote an upward direction, that is, a Z-axis direction, based on a display panel 100, and "lower portion," "bottom," and "lower surface" denote a downward direction, that is, an opposite direction of the Z-axis direction, based on the display panel 100. In addition, "left," "right," "upper," and "lower" denote directions when the display panel 100 is viewed from above. For example, "left," "right," "upper," and "lower" respectively denote an opposite direction of an X-axis direction, the X-axis direction, a Y-axis direction, and an opposite direction of the Y-axis direction.

Referring to FIGS. 1 to 3, an embodiment of the display device 10 is a device which displays moving images or static images and may be used as a display screen of a portable electronic device such as a mobile phone, a smart phone, a tablet personal computer ("PC"), a smart watch, a watch phone, a mobile communication terminal, an electronic notebook, an electronic book, a portable multimedia player ("PMP"), a navigation device, and an ultra-mobile PC, and various products such as a television set, a notebook, a monitor, a billboard, and an Internet of Things ("IoT") product, for example.

The display device 10 may be a light emitting display device such as an organic light emitting display device using an organic light emitting diode, a quantum dot light emitting display device including a quantum dot light emitting layer, an inorganic light emitting display device including an inorganic semiconductor, and a micro light emitting display device using a micro light emitting diode ("LED"). Hereinafter, for convenience of description, embodiments where the display device 10 is the organic light emitting display device will be mainly described in detail, but the invention is not limited thereto.

The display device 10 includes the display panel 100, a display driving circuit 200, and a circuit board 300.

The display panel 100 may have a flat surface having a rectangular shape including short sides in a first direction (X-axis direction) and long sides in a second direction (Y-axis direction) intersecting the first direction (X-axis direction). Corners of the flat surface at which the short sides in the first direction (X-axis direction) meet the long sides in the second direction (Y-axis direction) may be rounded with predetermined curvatures or be at right angles. A shape of the display panel 100 viewed from a top plan view (or a plan view in Z-axis direction) is not limited to a quadrilateral shape, and may be variously modified to be another polygonal shape, a circular shape, or an oval shape. The display panel 100 may be flat but is not limited thereto, and alternatively, the display panel 100 may include curved surface portions formed at left and right ends thereof and having a predetermined curvature or various curvatures. In an embodiment, the display panel 100 may be flexible to be bent, curved, folded, or rolled.

The display panel 100 may include a display area DA, in which sub-pixels SP are disposed and on which an image is displayed, and a non-display area NDA which is an area around the display area DA. In the display area DA, scan lines SL, emission lines EL, data lines DL and first driving voltage lines VDDL, which are connected to the sub-pixels SP, may be disposed in addition to the sub-pixels SP. The scan lines SL and the emission lines EL may extend in a direction parallel to the first direction (X-axis direction), and the data lines DL may extend in a direction parallel to the second direction (Y-axis direction) intersecting the first direction (X-axis direction). The first driving voltage lines VDDL may extend in a direction parallel to the second direction (Y-axis direction) in the display area DA. The first driving voltage lines VDDL, which extend in the direction parallel to the second direction (Y-axis direction) in the display area DA, may be connected to each other in the non-display area NDA.

Each of the sub-pixels SP may be connected to a corresponding scan line among the scan lines SL, a corresponding data line among the data lines DL, aa corresponding emission line among the emission lines EL, and the first driving voltage line VDDL. In an embodiment, as shown in FIG. 2, each of the sub-pixels SP is connected to two corresponding scan lines SL, one data line DL, one corresponding emission line EL, and the first driving voltage line VDDL, but the sub-pixel SP is not limited thereto. In one alternative embodiment, for example, each of the sub-pixels SP may also be connected to three scan lines SL instead of two scan lines SL.

Each of the sub-pixels SP may include a driving transistor, a switching transistor, a light emitting element, and a capacitor. The switching transistor is turned on in response to a scan signal applied thereto through the scan line SL, and accordingly, a data voltage of the data line DL may be applied to a gate electrode of the driving transistor DT. The driving transistor DT supplies a driving current to the light emitting element in response to the data voltage applied to the gate electrode such that the light emitting element may emit light. Each of the driving transistor DT and the switching transistor may be a thin film transistor. The light emitting element may emit light corresponding to the driving current of the driving transistor DT. The light emitting element may be an organic LED including a first electrode, an organic light emitting layer, and a second electrode. The capacitor may serve to constantly maintain the data voltage applied to the gate electrode of the driving transistor DT.

In an embodiment, the non-display area NDA may be defined by an area from an outer side of the display area DA to an edge of the display panel 100. In such an embodiment, a scan driving circuit 400 configured to apply scan signals to the scan lines SL, fan-out lines FL between the data lines DL and the display driving circuit 200, and pads DP connected to the display driving circuit 200 may be disposed in the non-display area NDA. The display driving circuit 200 and the pads DP may be disposed near a side edge of the display panel 100. The pads DP may be disposed to be closer to the side edge of the display panel 100 than the display driving circuit 200.

The scan driving circuit 400 may be connected to the display driving circuit 200 through a scan control line SCL. The scan driving circuit 400 may receive scan control signals SCS and emission control signals ECS from the display driving circuit 200 through the scan control line SCL.

In an embodiment, as shown in FIG. 3, the scan driving circuit SDC may include a scan signal driver 410 and an emission signal driver 420.

The scan signal driver 410 may generate the scan signals based on the scan control signals SCS and sequentially output the scan signals to the scan lines SL. The emission signal driver 420 generates emission signals based on the emission control signals ECS and sequentially outputs emission control signals to the emission lines EL.

The scan driving circuit 400 may include a plurality of thin film transistors. The scan driving circuit 400 may be disposed in a layer which is the same layer in which the thin film transistors of the sub-pixels SP are disposed. In an embodiment, as shown in FIG. 2, the scan driving circuit 400 may be disposed near a single side of the display area DA, for example, in the left non-display area NDA, but is not limited thereto. In one alternative embodiment, for example, the scan driving circuit 400 may be disposed near both opposing sides from the display area DA, for example, in the left and right non-display area NDA.

In an embodiment, as illustrated in FIG. 3, the display driving circuit 200 may include a timing controller 210, a data driver 220, and a power supply unit 230.

The timing controller 210 receives digital video data DATA and timing signals from the circuit board 300. The timing controller 210 may generate the scan control signals SCS for controlling operation timings of the scan signal driver 410 based on the timing signals, the emission control signal ECS for controlling operation timings of the emission signal driver 420 based on the timing signals, and data control signals DCS for controlling operation timings of the data driver 220 based on the timing signals. The timing controller 210 may output the scan control signals SCS to the scan signal driver 410 and output the emission control signals ECS to the emission signal driver 420. The timing controller 210 may output the digital video data DATA and the data control signals DCS to the data driver 220.

The data driver 220 converts the digital video data DATA to analog positive/negative data voltages and outputs the analog positive/negative data voltages to the data lines DL through the fan-out lines FL. When the sub-pixels SP are selected (or turned on) in response to the scan signals of the scan driving circuit 400, the data voltages are supplied to the selected sub-pixels SP.

The power supply unit 230 may generate a first driving voltage and supply the first driving voltage to the first driving voltage line VDDL. The power supply unit 230 may generate a second driving voltage and supply the second driving voltage to a cathode electrode of the organic LED of each of the sub-pixels SP. The first driving voltage may be a high potential voltage for driving the organic LED, and the second driving voltage may be a low potential voltage for driving the organic LED. That is, the first driving voltage may have potential higher than that of the second driving voltage.

The display driving circuit 200 may be formed as an integrated circuit ("IC") and disposed on the display panel 100 through a chip on glass ("COG") method, a chip on plastic ("COP") method or an ultrasonic bonding method, for example, but is not limited thereto. In one embodiment, for example, the display driving circuit 200 may be disposed on the circuit board 300. The power supply unit 230 may be disposed on the circuit board 300.

The circuit board 300 may be attached onto the pads DP using an anisotropic conductive film. Accordingly, lead lines of the circuit board 300 may be electrically connected to the pads DP. The circuit board 300 may be a flexible printed circuit board, a printed circuit board, or a flexible film such as a chip on film.

Figure 4:
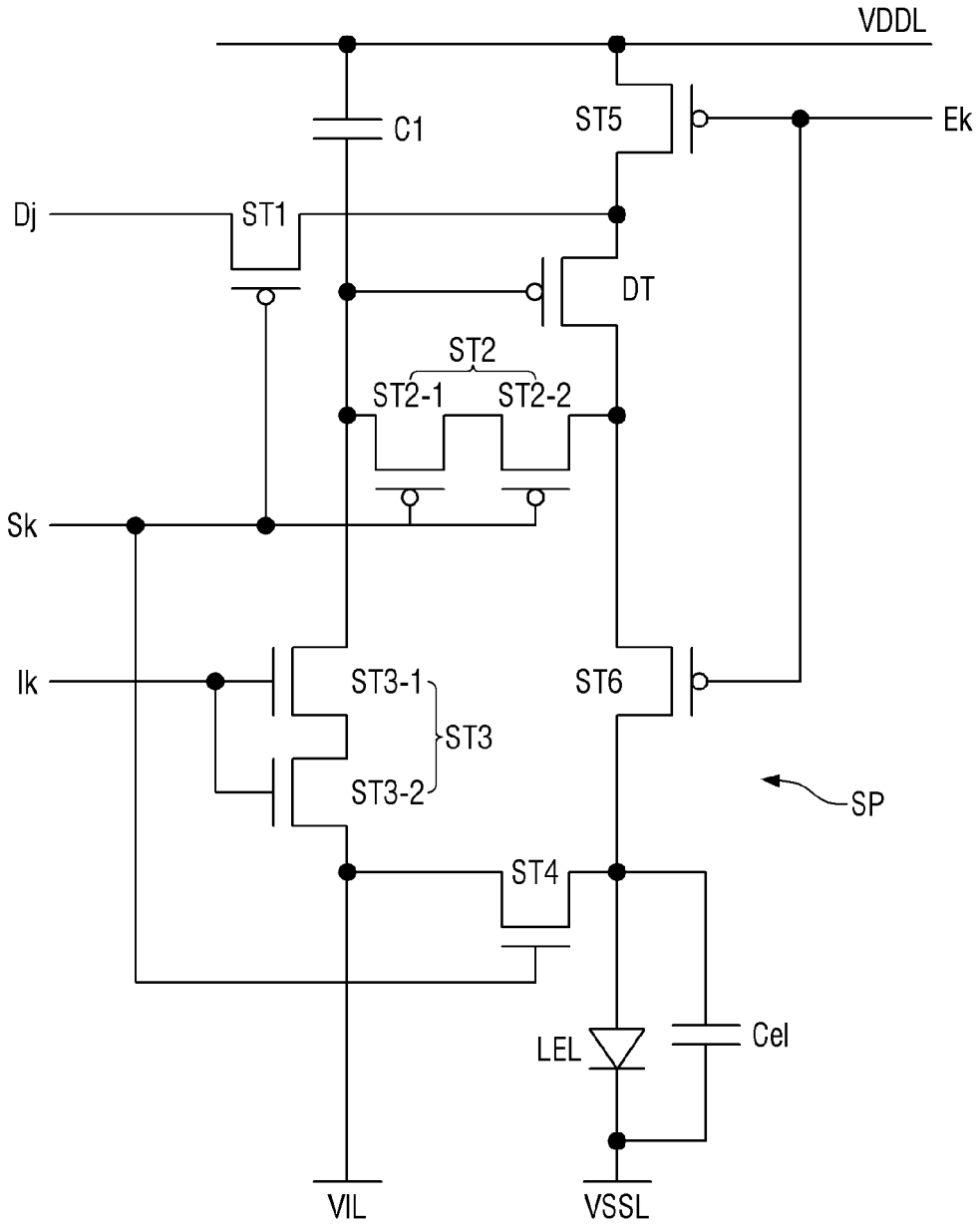
FIG. 4 is a circuit diagram illustrating a sub-pixel according to an embodiment.

FIG. 4 is a circuit diagram illustrating a sub-pixel according to an embodiment.

Referring to FIG. 4, in an embodiment, a sub-pixel SP may be connected to a corresponding initialization line, e.g., a $k^{th}$ initialization line Ik (k is a positive integer greater than or equal to 2), a corresponding scan line, e.g., a $k^{th}$ scan line Sk, and a corresponding data line, e.g., a $j^{th}$ data line Dj (j is a positive integer). In such an embodiment, the sub-pixel SP may be connected to a first driving voltage line VDDL through which a first driving voltage is supplied, an initialization voltage line VIL through which an initialization voltage Vini is supplied, and a second driving voltage line VSSL through which a second driving voltage is supplied.

The sub-pixel SP includes a driving transistor DT, a light emitting element LE, switch elements, a first capacitor C1, and the like. The switch elements include first to sixth switching transistors ST1, ST2, ST3, ST4, ST5, and ST6.

In an embodiment, as illustrated in FIG. 4, the first, second, fifth and sixth switching transistors ST, ST2, ST5 and ST6, and the driving transistor DT may be P-type transistors, and the third and fourth transistors ST3 and ST4 may be N-type transistors. The P-type transistors are turned on by a gate low voltage, while the N-type transistors are turned on by a gate high voltage.

The driving transistor DT controls a drain-source current Ids (hereinafter, refers to a driving current) in response to a data voltage applied to a gate electrode. The driving current Ids flowing through a channel of the driving transistor DT is proportional to square of a difference between a voltage (Vgs) between the gate electrode and a source electrode, and a threshold voltage of the driving transistor DT as in the following equation:

$$Ids=k'\times(Vgs-Vth)^2.$$

In the equation above, k' denotes a proportional coefficient determined based on a structure and physical properties of a driving transistor, Vgs denotes a gate-source voltage of the driving transistor, and Vth denotes a threshold voltage of the driving transistor.

The light emitting element LEL emits light corresponding to the driving current Ids. An amount of emitted light of the light emitting element LEL may be substantially proportional to the driving current Ids.

In an embodiment, the light emitting element LEL may be an organic LED including an anode electrode, a cathode electrode, and an organic light emitting layer disposed between the anode electrode and the cathode electrode. Alternatively, the light emitting element LEL may be an inorganic light emitting element including an anode electrode, a cathode electrode, and an inorganic semiconductor disposed between the anode electrode and the cathode electrode. Alternatively, the light emitting element LEL may be a quantum dot light emitting element including an anode electrode, a cathode electrode, and a quantum dot light emitting layer disposed between the anode electrode and the cathode electrode. Alternatively, the light emitting element LEL may be a micro LED.

An anode electrode of the light emitting element LEL may be connected to a first electrode of the fourth switching transistor ST4 and a second electrode of the sixth switching transistor ST6, and a cathode electrode may be connected to the second driving voltage line VSSL. A parasitic capacitor Cel may be connected between the anode electrode and the cathode electrode of the light emitting element LEL.

The first switching transistor ST1 is turned on by a scan signal of the $k^{th}$ scan line Sk and connects a first electrode of the driving transistor DT and the $j^{th}$ data line Dj. A gate electrode of the first switching transistor ST1 may be connected to the $k^{th}$ scan line Sk, a first electrode of the first switching transistor ST1 may be connected to the first electrode of the driving transistor DT, and a second electrode of the first switching transistor ST1 may be connected to the data line Dj.

The second switching transistor ST2 may be a dual transistor including a first second switching transistor ST2-1 and a second second switching transistor ST2-2. The first second switching transistor ST2-1 and the second second switching transistor ST2-2 are turned on by the scan signal of the $k^{th}$ scan line Sk to connect the gate electrode and the second electrode of the driving transistor DT. That is, in a case in which the first second switching transistor ST2-1 and the second second switching transistor ST2-2 are turned on, since the gate electrode and the second electrode of the driving transistor DT are connected, the driving transistor DT is driven as a diode. A gate electrode of the first second switching transistor ST2-1 may be connected to the $k^{th}$ scan line Sk, a first electrode of the first second switching transistor ST2-1 may be connected to a second electrode of the second second switching transistor ST2-2, and a second electrode of the first second switching transistor ST2-1 may be connected to the gate electrode of the driving transistor DT. A gate electrode of the second second switching transistor ST2-2 may be connected to the $k^{th}$ scan line Sk, and a first electrode of the second second switching transistor ST2-2 may be connected to the second electrode of the driving transistor DT, and a second electrode of the second second switching transistor ST2-2 may be connected to the first electrode of the first second switching transistor ST2-1.

The third switching transistor ST3 may be a dual transistor including a first third switching transistor ST3-1 and a second third switching transistor ST3-2. The first third switching transistor ST3-1 and the second third switching transistor ST3-2 are turned on by a scan signal of a $k^{th}$ initialization line Ik and connect the gate electrode of the driving transistor DT and the initialization voltage line VIL. The gate electrode of the driving transistor DT may be initialized to have an initialization voltage of the initialization voltage line VIL. A gate electrode of the first third switching transistor ST3-1 may be connected to the $k^{th}$ initialization line Ik, a first electrode of the first third switching transistor ST3-1 may be connected to a second electrode of the second third switching transistor ST3-2, a second electrode of the first third switching transistor ST3-1 may be connected to the gate electrode of the driving transistor DT. A gate electrode of the second third switching transistor ST3-2 may be connected to the $k^{th}$ initialization line Ik, and a first electrode of the second third switching transistor ST3-2 may be connected to the initialization voltage line VIL, a second electrode of the second third switching transistor ST3-2 may be connected to the first electrode of the first third switching transistor ST3-1.

The fourth switching transistor ST4 is turned on by the scan signal of the $k^{th}$ scan line Sk and connects the anode electrode of the light emitting element LEL and the initialization voltage line VIL. The anode electrode of the light emitting element LEL may be initialized to have the initialization voltage. A gate electrode of the fourth switching transistor ST4 is connected to the $k^{th}$ scan line Sk, a first electrode of the fourth switching transistor ST4 is connected to the initialization voltage line VIL, and a second electrode of the fourth switching transistor ST4 is connected to the anode electrode light emitting element LEL.

The fifth switching transistor ST5 is turned on by an emission control signal of a $k^{th}$ emission line Ek and connects the first electrode of the driving transistor DT and the first driving voltage line VDDL. A gate electrode of the fifth switching transistor ST5 is connected to the $k^{th}$ emission line Ek, a first electrode of the fifth switching transistor ST5 is connected to the first driving voltage line VDDL, and a second electrode of the fifth switching transistor ST5 is connected to the source electrode of the driving transistor DT.

The sixth switching transistor ST6 is connected between the second electrode of the driving transistor DT and the anode electrode of the light emitting element LEL. The sixth switching transistor ST6 is turned on by the emission control signal of the $k^{th}$ emission line Ek and connects the second electrode of the driving transistor DT and the anode electrode of the light emitting element LEL. The gate electrode of the sixth switching transistor ST6 is connected to the $k^{th}$ emission line Ek, a first electrode of the sixth switching transistor ST6 is connected to the second electrode of the driving transistor DT, and a second electrode of the sixth switching transistor ST6 is connected to the anode electrode of the light emitting element LEL. In a case in which both of the fifth switching transistor ST5 and the sixth switching transistor ST6 are turned on, the driving current Ids may be supplied to the light emitting element LEL.

A first capacitor C1 is connected between the second electrode of the driving transistor DT and the first driving voltage line VDDL. One electrode of the first capacitor C1 may be connected to the second electrode of the driving transistor DT, and the other electrode thereof may be connected to the first driving voltage line VDDL.

In an embodiment in which the first electrode of each of the first to sixth switching transistors ST1, ST2, ST3, ST4, ST5 and ST6, and the driving transistor DT is a source electrode, the second electrode thereof may a be drain electrode. In an alternative embodiment in which the first electrode of each of the first to sixth switching transistors ST1, ST2, ST3, ST4, ST5 and ST6, and the driving transistor DT is a drain electrode, the second electrode thereof may be a source electrode.

An active layer of each of the first to sixth switching transistors ST1, ST2, ST3, ST4, ST5, and ST6, and the driving transistor DT may include or be formed of at least one material selected from poly silicon, amorphous silicon, and an oxide semiconductor. In an embodiment in which a semiconductor layer of each of the first to sixth switching transistors ST1, ST2, ST3, ST4, ST5 and ST6, and the driving transistor DT is formed of poly silicon, a process for forming the semiconductor layer may be a low temperature poly silicon ("LTPS") process.

Figure 5:
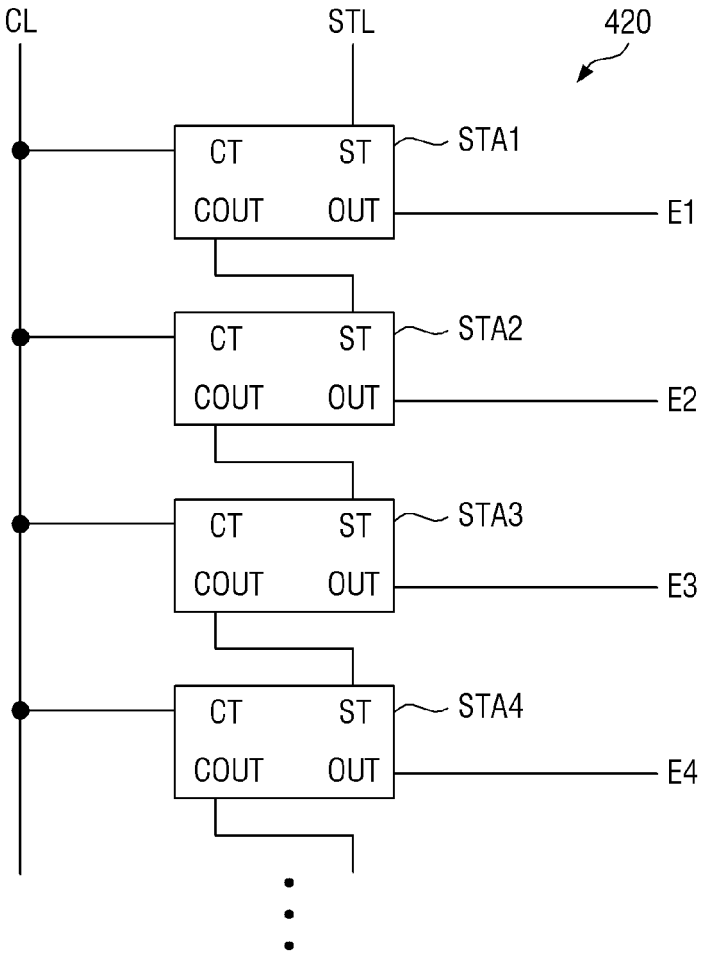
FIG. 5 is a view illustrating an embodiment of an emission signal driver.

FIG. 5 is a view illustrating an embodiment of the emission signal driver.

Referring to FIG. 5, an embodiment of the emission signal driver includes a plurality of stages STA to STA4 respectively connected to emission lines E1 to E4, a start signal line STL through which a start signal is applied, and a clock line CL through which a clock signal is applied. The start signal and the clock signal correspond to emission control signals ECS.

For convenience of illustration and description, only the first to fourth stages STA to STA4 respectively connected to the first to fourth emission lines E1 to E4 are illustrated in FIG. 5. Fifth to $n^{th}$ (n is an integer greater than or equal to 6) stages STA5 to STAn of the emission signal driver 420 may be substantially the same as the first to fourth stages STA1 to STA4.

In the following description, "pre-stage" denotes a stage positioned prior to a reference stage. "Post-stage" denotes a stage positioned following a reference stage. For example, pre-stages of the third stage STA3 denote the first and second stages STA1 and STA2, and post-stages of the third stage STA3 denote the fourth to $n^{th}$ stages.

Each of the stages STA1 to STA4 include a start terminal ST, a clock terminal CT, an output terminal OUT, and a carry signal terminal COUT.

The start terminals ST of the stages STA1 to STA4 are connected to the start signal line STL or the carry signal terminals COUT of the pre-stages thereof. In one embodiment, for example, a start terminal ST of a $k^{th}$ stage STAk (k is an integer satisfying $1 \leq k \leq n$) may be connected to the start signal line STL or a carry signal terminal COUT of a $(k-1)^{th}$ stage STAk−1.

The clock terminals CT of the stages STA1 to STA4 may be connected to the clock line CL. The output terminals OUT of the stages STA1 to STA4 are connected to emission lines and output emission signals to the emission lines.

The carry signal terminal COUT of each of the stages STA1 to STA4 is connected to the start terminal ST of the post-stages. In one embodiment, for example, the carry signal terminal COUT of the $k^{th}$ stage STAk may be connected to a start terminal ST of a $(k+1)^{th}$ stage STAk+1.

According to an embodiment, as illustrated in FIG. 5, the stages STA1 to STA4 of the emission signal driver 420 are connected to a same clock line CL as each other and receive a same clock signal as each other. Therefore, the number of the clock lines CL connected to the stages STA1 to STA4 of the emission signal driver 420 may be reduced. Accordingly, in such an embodiment, an area of the emission signal driver 420 may be decreased, such that the non-display area NDA of the display panel 100 may be decreased.

Figure 6:
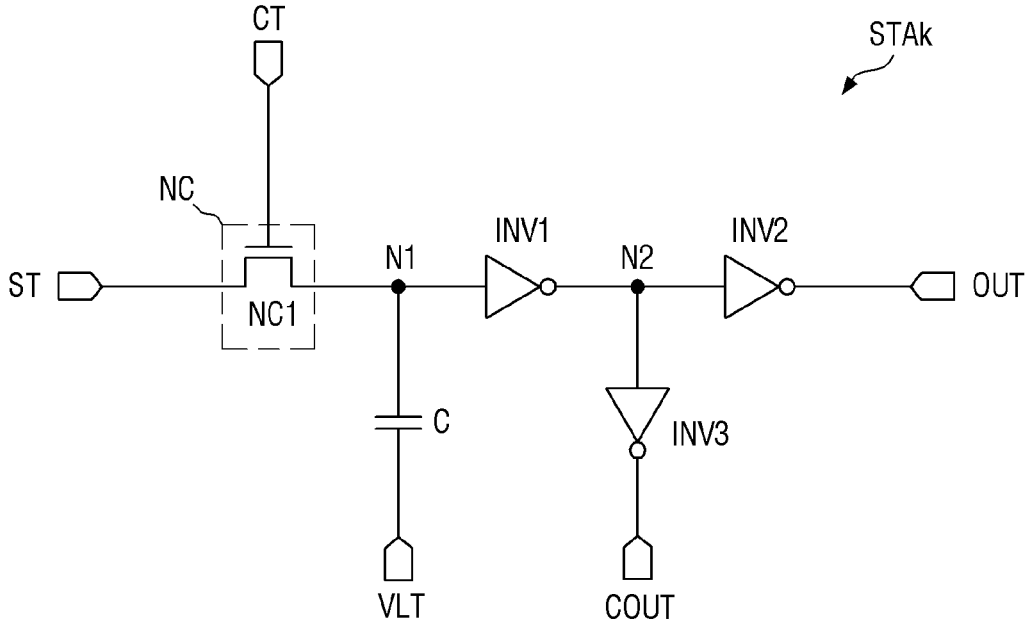
FIG. 6 is a view illustrating an embodiment of a $k^{th}$ stage of the emission signal driver.
Figure 7:
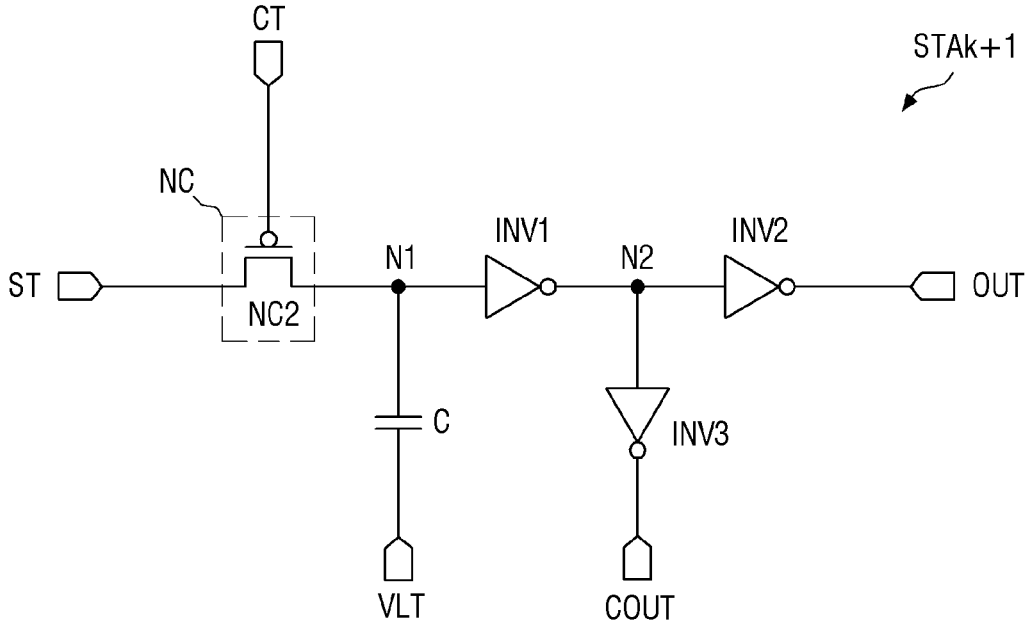
FIG. 7 is a view illustrating an embodiment of a $(k+1)^{th}$ stage of the emission signal driver.
Figure 8:
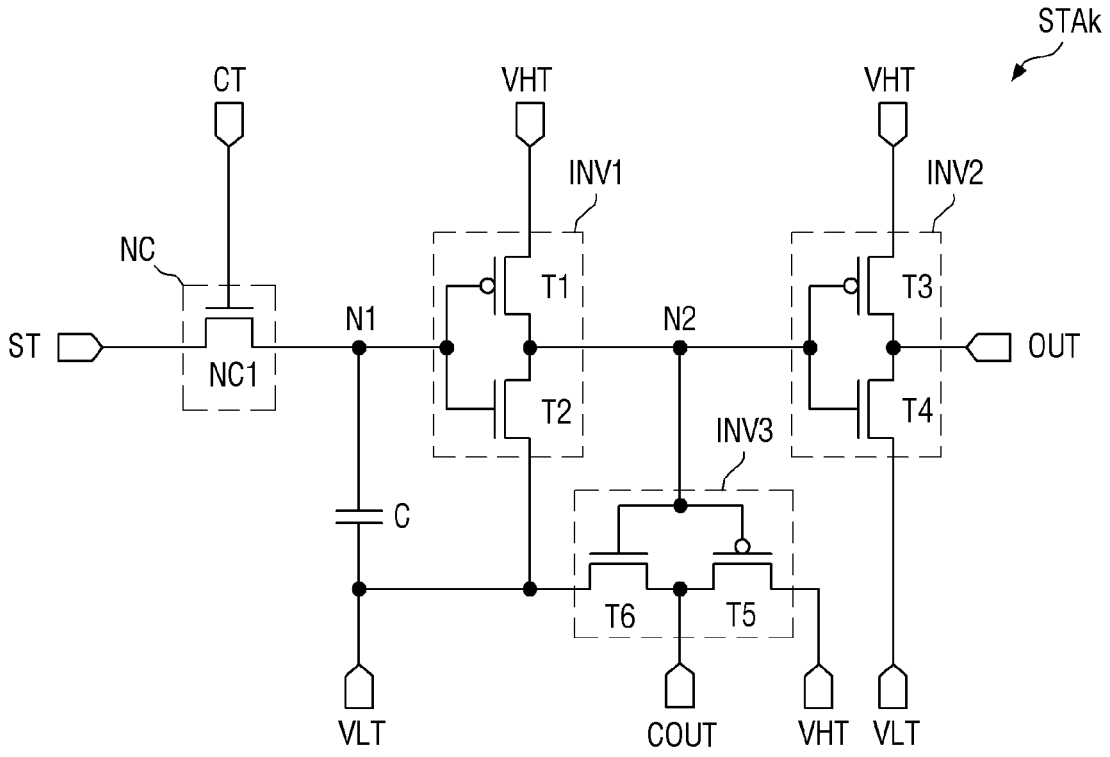
FIG. 8 is a circuit diagram illustrating an embodiment of the $k^{th}$ stage of FIG. 6.
Figure 9:
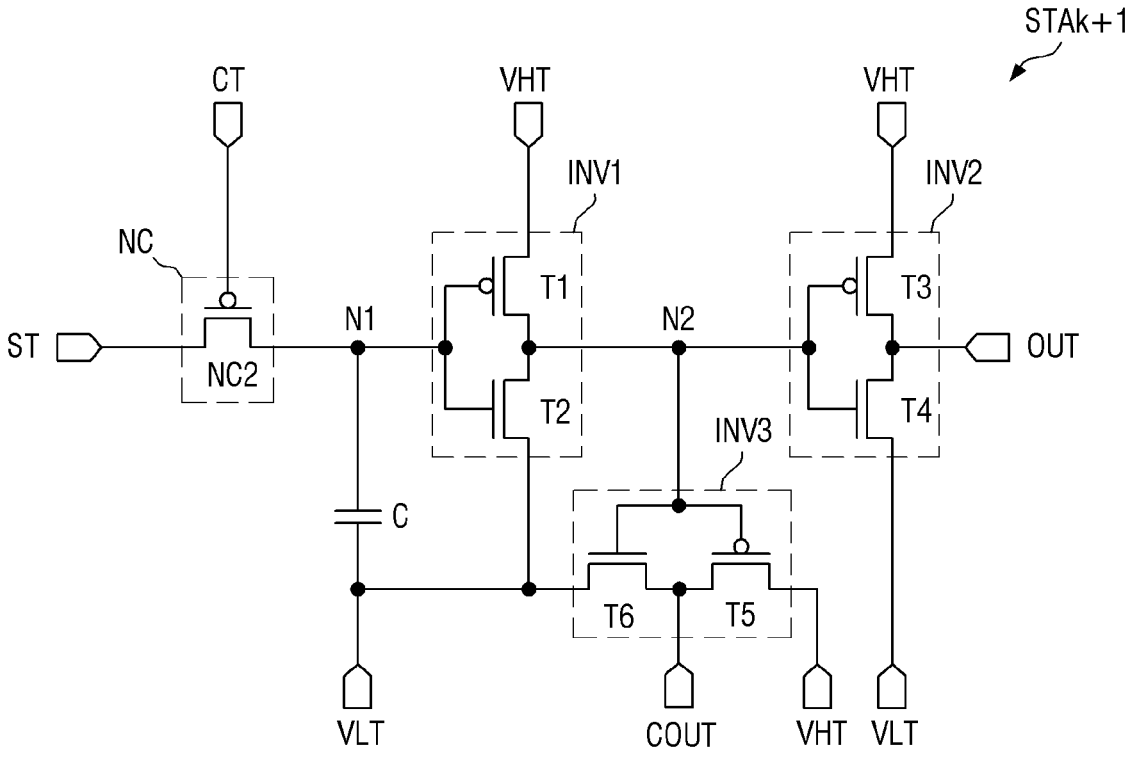
FIG. 9 is a circuit diagram illustrating an embodiment of the $(k+1)^{th}$ stage of FIG. 6.

FIG. 6 is a view illustrating an embodiment of the $k^{th}$ stage of the emission signal driver. FIG. 7 is a view illustrating an embodiment of the $(k+1)^{th}$ stage of the emission signal driver. FIG. 8 is a circuit diagram illustrating an embodiment of the $k^{th}$ stage of FIG. 6. FIG. 9 is a circuit diagram illustrating an embodiment of the $(k+1)^{th}$ stage of FIG. 6.

Referring to FIGS. 6 to 9, in an embodiment, the $k^{th}$ stage STAk is an odd-numbered stage connected to an odd-numbered emission line, and the $(k+1)^{th}$ stage STAk+1 is an even-numbered stage connected to an even-numbered emission line. Alternatively, the $k^{th}$ stage STAk may be an even-numbered stage connected to an even-numbered emission line, and the $(k+1)^{th}$ stage STAk+1 may be an odd-numbered stage connected to an odd-numbered emission line.

In an embodiment, as shown in FIGS. 6 to 9, each of the $k^{th}$ stage STAk and the $(k+1)^{th}$ stage STAk+1 may include a first inverter INV1, a second inverter INV2, a third inverter INV3, a node controller NC, and a capacitor C. In such an embodiment, as shown in FIGS. 6 and 7, each of the $k^{th}$ stage STAk and the $(k+1)^{th}$ stage STAk+1 may include a start terminal ST, a clock terminal CT, an output terminal OUT, a carry signal terminal COUT and gate low voltage terminals VLT. Gate low voltages may be applied to the gate low voltage terminals VLT. In such an embodiment, as shown in FIGS. 8 and 9, the $k^{th}$ stage STAk and the $(k+1)^{th}$ stage STAk+1 may further include the gate high voltage terminals VHT, to which gate high voltages are applied.

In an embodiment, as illustrated in FIGS. 8 and 9, first, third and fifth transistors T1, T3 and T5, and a second node control transistor NC2 may be P-type transistors, and second, fourth, and sixth transistors T2, T4 and T6, and a first node control transistor NC1 may be N-type transistors.

The first inverter INV1 is connected between a first node N1 and a second node N2. The first inverter INV1 may invert a voltage of the first node N1 and apply the inverted voltage to the second node N2. The first inverter INV1 may include the first transistor T1 and the second transistor T2.

The first transistor T1 may be turned on in a case in which the first node N1 has the gate low voltage and may apply the gate high voltage to the second node N2. A gate electrode of the first transistor T1 may be connected to the first node N1, a first electrode of the first transistor T1 may be connected to the gate high voltage terminal VHT, and a second electrode of the first transistor T1 may be connected to the second node N2.

The second transistor T2 may be turned on in a case in which the first node N1 has the gate high voltage and may apply the gate low voltage to the second node N2. A gate electrode of the second transistor T2 may be connected to the first node N1, a first electrode of the second transistor T2 may be connected to the gate low voltage terminal VLT, and a second electrode of the second transistor T2 may be connected to the second node N2.

The second inverter INV2 is connected between the second node N2 and the output terminal OUT. The second inverter INV2 may invert a voltage of the second node N2 and may apply the inverted voltage to the output terminal OUT. The second inverter INV2 may include a third transistor T3 and a fourth transistor T4. The third transistor T3 may be referred to as a first transistor of the second inverter INV2, and the fourth transistor T4 may be referred to as a second transistor of the second inverter INV2.

The third transistor T3 may be turned on in a case in which the second node N2 has the gate low voltage and may apply the gate high voltage to the output terminal OUT. A gate electrode of the third transistor T3 may be connected to the second node N2, a first electrode of the third transistor T3 may be connected to the gate high voltage terminal VHT, and a second electrode of the third transistor T3 may be connected to the output terminal OUT.

The fourth transistor T4 may be turned on in a case in which the second node N2 has the gate high voltage and may apply the gate low voltage to the output terminal OUT. A gate electrode of the second transistor T2 may be connected to the second node N2, a first electrode of the second transistor T2 may be connected to the gate low voltage terminal VLT, and a second electrode of the second transistor T2 may be connected to the output terminal OUT.

The third inverter INV3 is connected between the second node N2 and the carry signal terminal COUT. The third inverter INV3 may invert a voltage of the second node N2 and may apply the inverted voltage to the carry signal terminal COUT. The third inverter INV3 may include a fifth transistor T5 and a sixth transistor T6. The fifth transistor T5 may be referred to as a first transistor of the third inverter INV3 and the sixth transistor T6 may be referred to as a second transistor of the third inverter INV3.

The fifth transistor T5 may be turned on in the case in which the second node N2 has the gate low voltage and may apply the gate high voltage to the carry signal terminal COUT. A gate electrode of the fifth transistor T5 may be connected to the second node N2, a first electrode of the fifth transistor T5 may be connected to the gate high voltage terminal VHT, and a second electrode of the fifth transistor T5 may be connected to the carry signal terminal COUT.

The sixth transistor T6 may be turned on in the case in which the second node N2 has the gate high voltage and may apply the gate low voltage to the carry signal terminal COUT. A gate electrode of the sixth transistor T6 may be connected to the second node N2, a first electrode of the sixth transistor T6 may be connected to the gate low voltage terminal VLT, and a second electrode of the sixth transistor T6 may be connected to the carry signal terminal COUT.

The capacitor C may be connected between the first node N1 and the gate low voltage terminal VLT to maintain a voltage of the first node N1. An electrode of one side of the capacitor C may be connected to the first node N1, and an electrode of the other side of the capacitor C may be connected to the gate low voltage terminal VLT.

The node controller NC of each of the $k^{th}$ stage STAk and the $(k+1)^{th}$ stage STAk+1 is connected to the start terminal ST and the first node N1. The node controller NC of the kth stage STAk may apply a start signal or carry signal, which is input to the start terminal ST, to the first node N1 in response to a clock signal input to the clock terminal CT.

The node controller NC of the $k^{th}$ stage STAk may include a first node control transistor NC1. The first node control transistor NC1 may be turned on in a case in which a clock signal having the gate low voltage is applied thereto and may apply a start signal or a $(k-1)^{th}$ carry signal to the first node N1. A gate electrode of the first node control transistor NC1 may be connected to the clock terminal CT, a first electrode of the first node control transistor NC1 may be connected to the first node N1, and a second electrode of the first node control transistor NC1 may be connected to the start terminal ST.

The node controller NC of the $(k+1)^{th}$ stage STAk+1 may include a second node control transistor NC2. The second node control transistor NC2 may be turned on in a case in which a clock signal having the gate high voltage is applied thereto and may apply a start signal or $k^{th}$ carry signal to the first node N1. A gate electrode of the second node control transistor NC2 may be connected to the clock terminal CT, a first electrode of the second node control transistor NC2 may be connected to the start terminal ST, and a second electrode of the second node control transistor NC2 may be connected to the first node N1.

In an embodiment, in which each of the stages STAk and STAk+1 includes a pull-up transistor, which is turned on by a voltage of a pull-up node and outputs a clock signal CLK to the output terminal OUT, and a capacitor C which is connected between the output terminal OUT and the pull-up node, a gate-source voltage and a drain-source voltage of the pull-up transistor may be increased since bootstrapping occurs. According to an embodiment, as illustrated in FIGS. 6 to 9, in each of the stages STAk and STAk+1 of the emission signal driver 420, since the capacitor C is connected to the first node N1, the gate high voltage and the gate low voltage may be output to the output terminal OUT without bootstrapping. Therefore, increases in the gate-source voltage and the drain-source voltage of each of the transistors T3 and T4 connected to the output terminal OUT of each of the stages STAk and STAk+1 of the emission signal driver 420 may be effectively prevented, such that reliability of the transistors T3 and T4 connected to the output terminal OUT may be improved.

Figure 10:
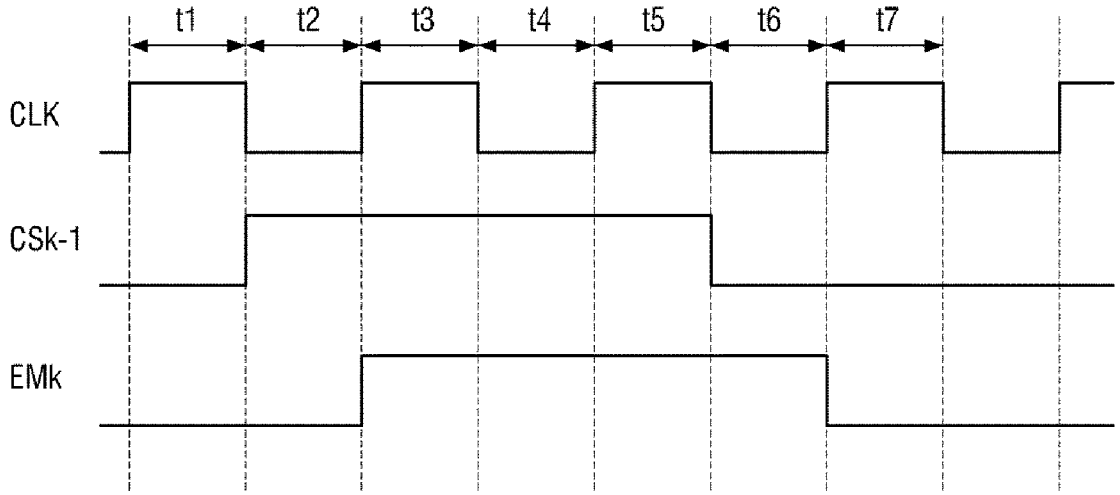
FIG. 10 is a waveform diagram illustrating a clock signal, a $(k-1)^{th}$ carry signal, and a $k^{th}$ emission signal.

FIG. 10 is a waveform diagram illustrating a clock signal, a $(k-1)^{th}$ carry signal, a $k^{th}$ emission signal, and a $k^{th}$ carry signal Referring to FIG. 10, a clock signal CLK is a signal applied to the clock terminal CT of the $k^{th}$ stage STAk. A $(k-1)^{th}$ carry signal CSk−1 is a signal output to the carry signal terminal COUT of the $(k-1)^{th}$ stage STAk−1 and applied to the start terminal ST of the $k^{th}$ stage STAk. The $k^{th}$ emission signal EMk is a signal output to the output terminal OUT of the $k^{th}$ stage STAk. Each of the clock signal CLK, the $(k-1)^{th}$ carry signal CSk−1, and the $k^{th}$ emission signal EMk swings between the gate low voltage and the gate high voltage.

The clock signal CLK may be repeated with a predetermined period. The period of the clock signal CLK may include about two horizontal periods. In one embodiment, for example, the clock signal CLK may have the gate high voltage for one horizontal period of two horizontal periods and the gate low voltage for the remaining one horizontal period.

Each of the $(k-1)^{th}$ carry signal CSk−1 and the $k^{th}$ emission signal EMk may be repeated with one frame period. Each of the $(k-1)^{th}$ carry signal CSk−1 and the $k^{th}$ emission signal EMk may have the gate high voltage for an even-numbered horizontal period of the one frame period and the gate low voltage for the remaining periods. In one embodiment, for example, as illustrated in FIG. 10, each of the $(k-1)^{th}$ carry signal CSk−1 and the $k^{th}$ emission signal EMk may have the gate high voltage for four horizontal periods. The $(k-1)^{th}$ carry signal CSk−1 and the $k^{th}$ emission signal EMk may overlap each other for at least one horizontal period.

In such an embodiment, since the $k^{th}$ carry signal CSk and the $k^{th}$ emission signal EMk are substantially the same as each other, a description about the $k^{th}$ carry signal CSk will be omitted. In such an embodiment, a start voltage instead of the $(k-1)^{th}$ carry signal CSk−1 may be applied to the start terminal ST.

FIGS. 11 to 17 are views illustrating the $k^{th}$ stage of FIG. 10 in first to seventh periods, respectively. Hereinafter, an operation of the $k^{th}$ stage in the first to seventh periods will be described in detail with reference to FIGS. 10 and 11 to 17.

Figure 11:
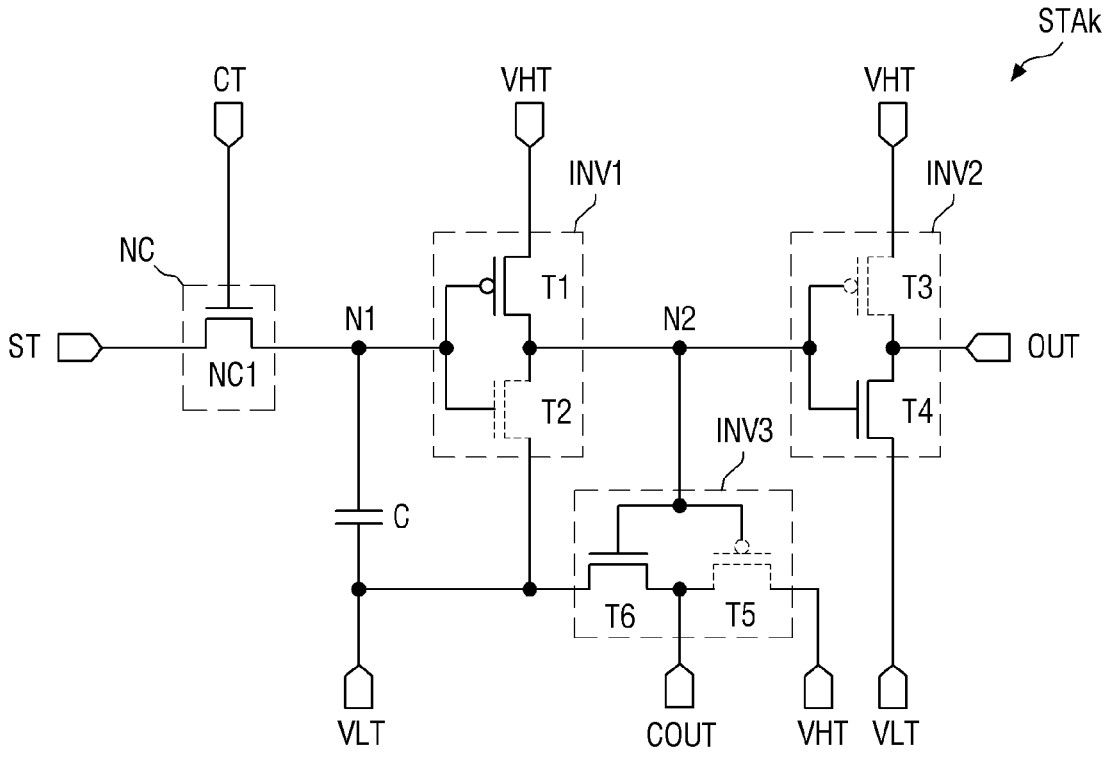
FIGS. 11 to 17 are views illustrating the $k^{th}$ stage of FIG. 10 in first to seventh periods, respectively.

In an embodiment, as illustrated in FIG. 10, in a first period t, a $(k-1)^{th}$ carry signal CSk−1 having a gate low voltage is applied to the start terminal ST, and a clock signal CLK having a gate high voltage is applied to the clock terminal CT. As illustrated in FIG. 11, in the first period t, since the first node control transistor NC1 of the $k^{th}$ stage STAk is turned on, the first node N1 is discharged to have the gate low voltage.

In the case in which the first node N1 has the gate low voltage, the first transistor T1 of the first inverter INV1 is turned on. Therefore, the second node N2 may be charged to have the gate high voltage.

In a case in which the second node N2 has the gate high voltage, the fourth transistor T4 of the second inverter INV2 is turned on. Therefore, the output terminal OUT may be charged to have the gate low voltage. Accordingly, in the first period t1, a $k^{th}$ emission signal EMk having the gate low voltage may be output to the output terminal OUT.

In the case in which the second node N2 has the gate high voltage, the sixth transistor T6 of the third inverter INV3 is turned on. Therefore, the carry signal terminal COUT may be charged to have the gate low voltage. Accordingly, in the first period t1, a $k^{th}$ carry signal CSk having the gate low voltage may be output to the carry signal terminal COUT.

Figure 12:
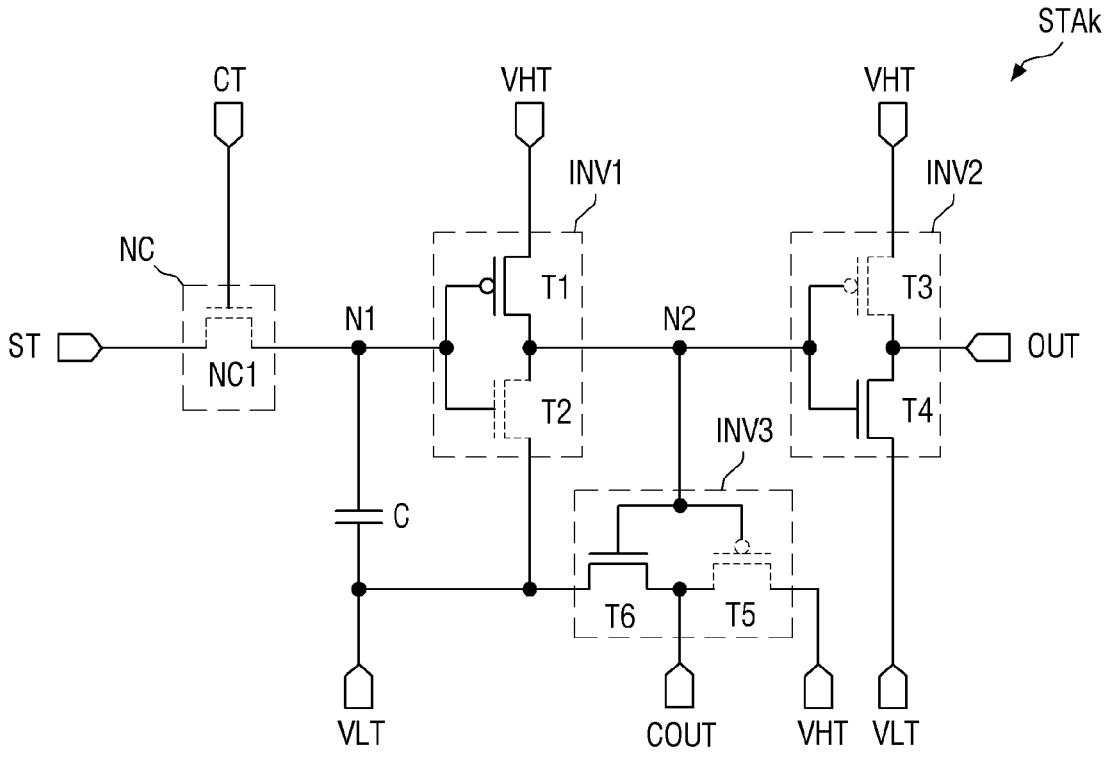

In such an embodiment, as illustrated in FIG. 10, in a second period t2, the $(k-1)^{th}$ carry signal CSk−1 having the gate high voltage is applied to the start terminal ST, and the clock signal CLK having the gate low voltage is applied to the clock terminal CT. As illustrated in FIG. 12, in the second period t2, since the first node control transistor NC1 of the $k^{th}$ stage STAk is also turned on, the first node N1 maintains the gate low voltage.

In the second period t2, since the first node N1 maintains the gate low voltage, the second node N2 maintains the gate high voltage as in the first period t1. Therefore, in the second period t2, the $k^{th}$ emission signal EMk having the gate low voltage may be output to the output terminal OUT, and the $k^{th}$ carry signal CSk having the gate low voltage may be output to the carry signal terminal COUT.

Figure 13:
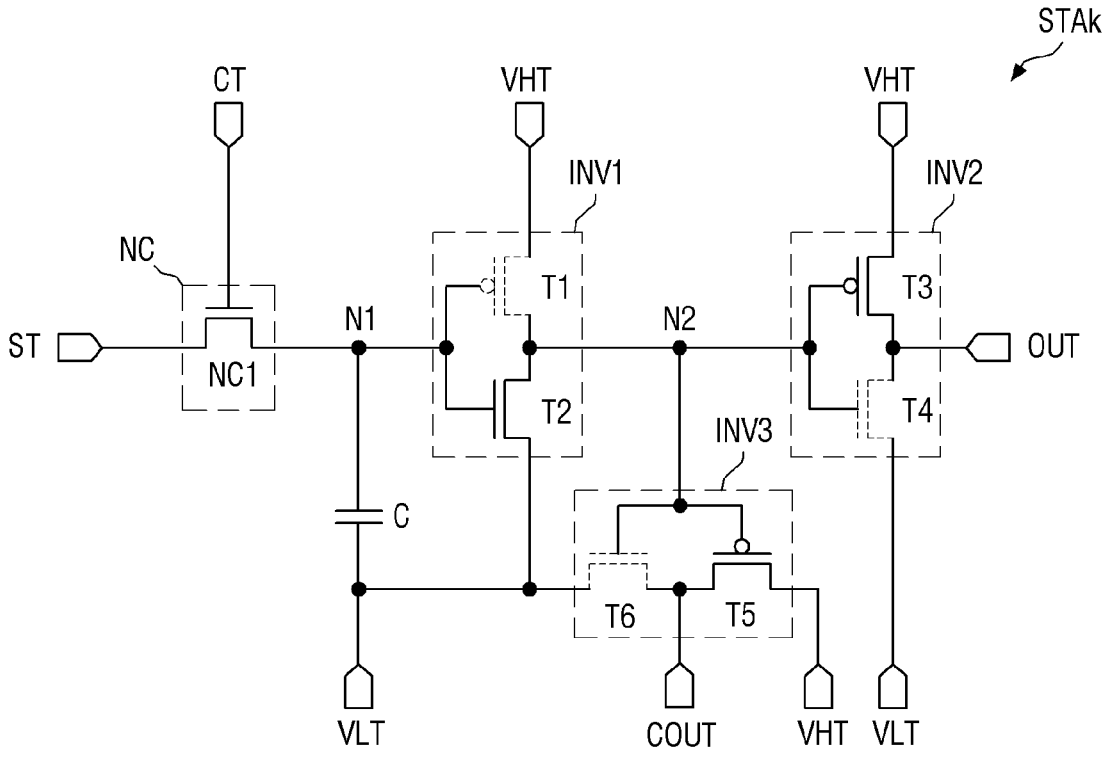

In such an embodiment, as illustrated in FIG. 10, in a third period t3, the $(k-1)^{th}$ carry signal CSk−1 having the gate high voltage is applied to the start terminal ST, and the clock signal CLK having the gate high voltage is applied to the clock terminal CT. As illustrated in FIG. 13, in the third period t3, since the first node control transistor NC1 of the $k^{th}$ stage STAk is turned on, the first node N1 is charged to have the gate high voltage.

In a case in which the first node N1 has the gate high voltage, the second transistor T2 of the first inverter INV1 is turned on. Therefore, the second node N2 may be discharged to have the gate low voltage.

In the case in which the second node N2 has the gate low voltage, the third transistor T3 of the second inverter INV2 is turned on. Therefore, the output terminal OUT may be charged to have the gate high voltage. Accordingly, for the third period t3, the $k^{th}$ emission signal EMk having the gate high voltage may be output to the output terminal OUT.

In the case in which the second node N2 has the gate low voltage, the fifth transistor T5 of the third inverter INV3 is turned on. Therefore, the carry signal terminal COUT may be charged to have the gate high voltage. Accordingly, in the third period t3, the $k^{th}$ carry signal CSk having the gate high voltage may be output to the carry signal terminal COUT.

Figure 14:
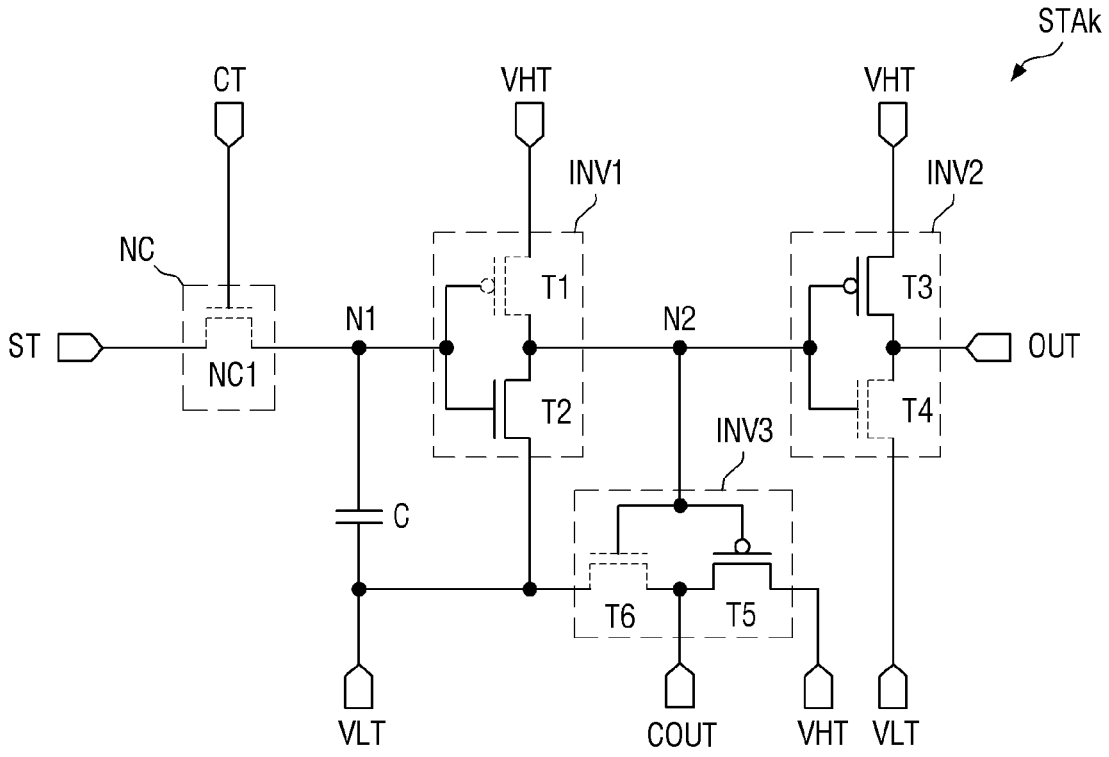

In such an embodiment, as illustrated in FIG. 10, in a fourth period t4, the $(k-1)^{th}$ carry signal CSk−1 having the gate high voltage is applied to the start terminal ST, and the clock signal CLK having the gate low voltage is applied to the clock terminal CT. As illustrated in FIG. 14, in the fourth period t4, since the first node control transistor NCT of the $k^{th}$ stage STAk is turned off, the first node N1 maintains the gate high voltage.

In the fourth period t4, since the first node N1 maintains the gate high voltage, the second node N2 maintains the gate low voltage as in the third period t3. Therefore, in the fourth period t4, the $k^{th}$ emission signal EMk having the gate high voltage may be output to the output terminal OUT, and the $k^{th}$ carry signal CSk having the gate high voltage may be output to the carry signal terminal COUT.

Figure 15:
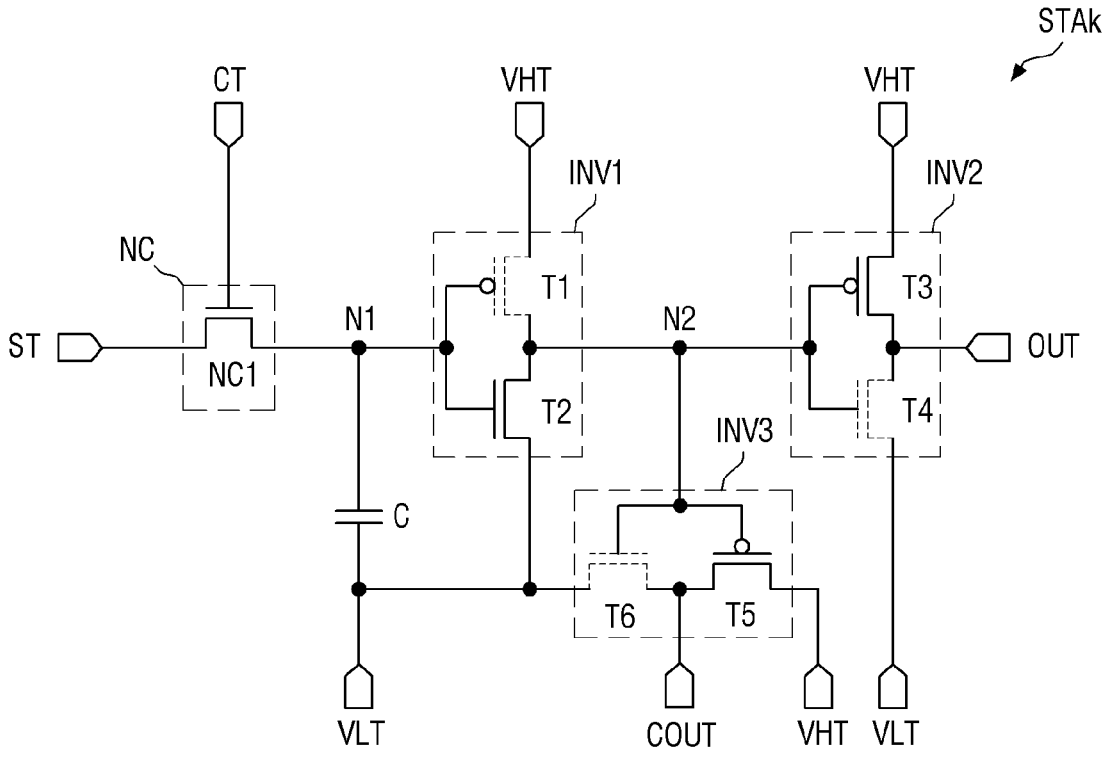

In such an embodiment, as illustrated in FIG. 10, in a fifth period t5, the $(k-1)^{th}$ carry signal CSk−1 having the gate high voltage is applied to the start terminal ST, and the clock signal CLK having the gate high voltage is applied to the clock terminal CT. As illustrated in FIG. 15, in the fifth period t5, since the first node control transistor NCT of the $k^{th}$ stage STAk is turned on, the first node N1 maintains the gate high voltage.

In the fifth period 15, since the first node N1 maintains the gate high voltage, the second node N2 maintains the gate low voltage as in the third period t3. Therefore, in the fifth period t5, the $k^{th}$ emission signal EMk having the gate high voltage may be output to the output terminal OUT, and the $k^{th}$ carry signal CSk having the gate high voltage may be output to the carry signal terminal COUT.

Figure 16:
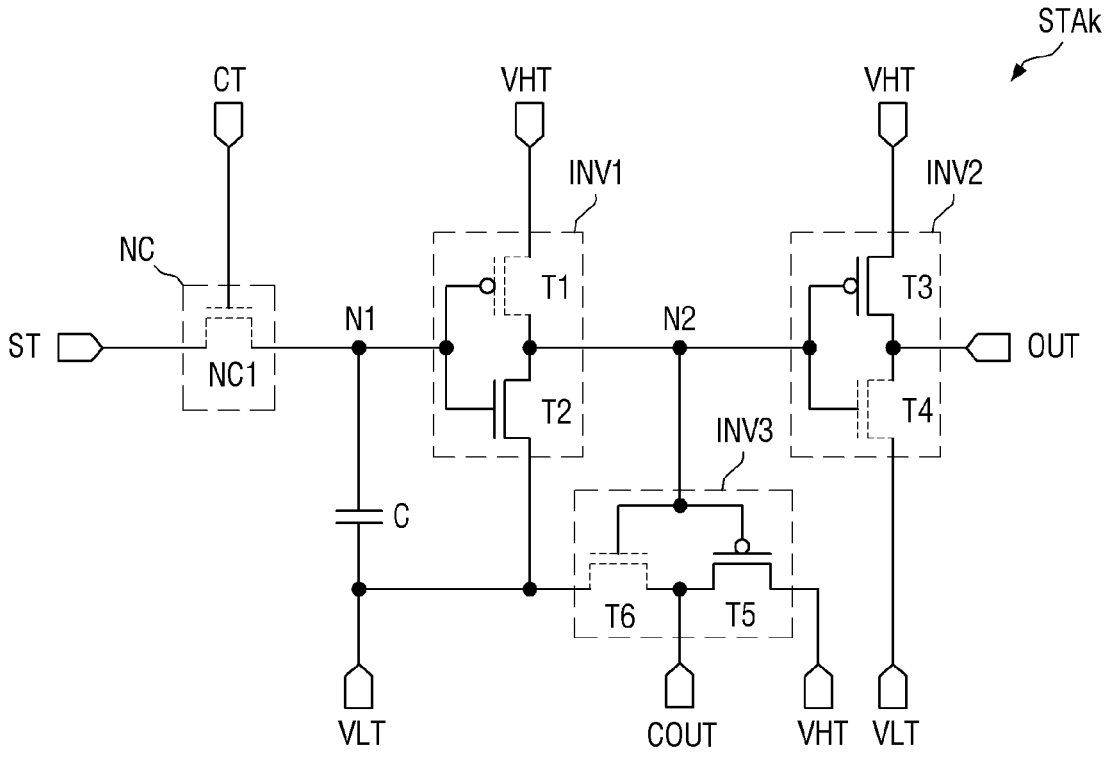

In such an embodiment, as illustrated in FIG. 10, in a sixth period t6, the $(k-1)^{th}$ carry signal CSk−1 having the gate low voltage is applied to the start terminal ST, and the clock signal CLK having the gate low voltage is applied to the clock terminal CT. As illustrated in FIG. 16, in the sixth period t6, since the first node control transistor NC1 of the $k^{th}$ stage STAk is turned off, the first node N1 maintains the gate high voltage.

In the sixth period t6, since the first node N1 maintains the gate high voltage, the second node N2 maintains the gate low voltage as in the third period t3. Therefore, in the sixth period t6, the $k^{th}$ emission signal EMk having the gate high voltage may be output to the output terminal OUT, and the $k^{th}$ carry signal CSk having the gate high voltage may be output to the carry signal terminal COUT.

Figure 17:
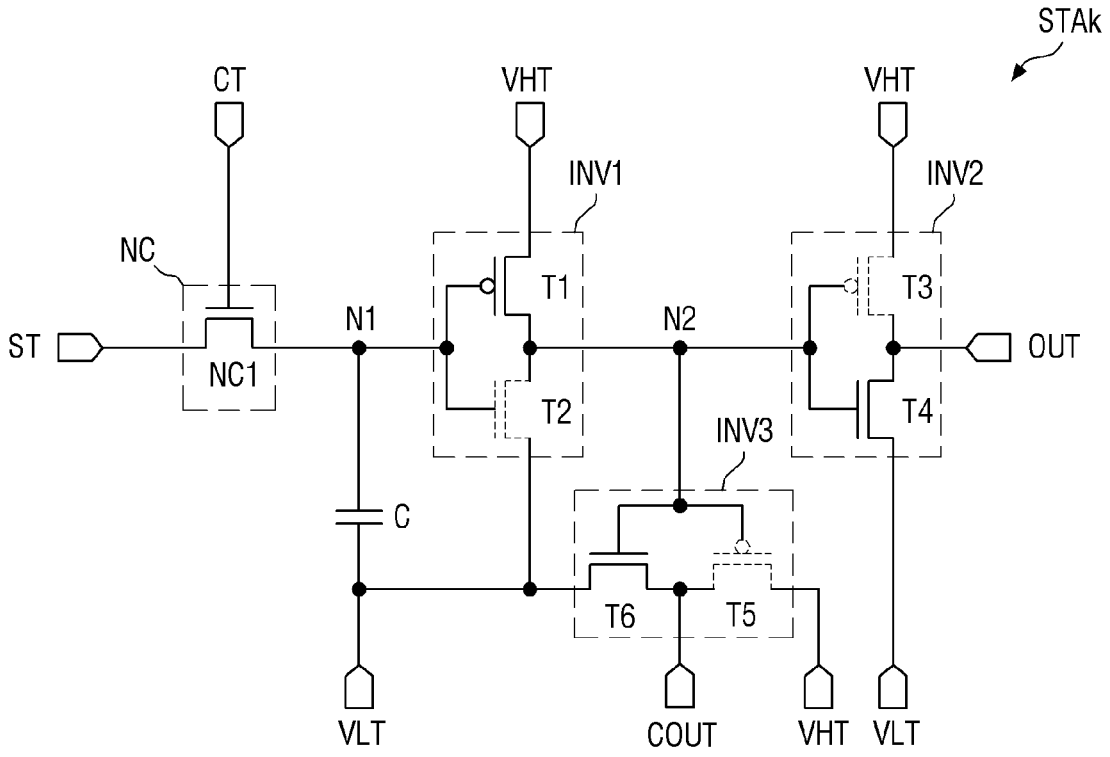

In such an embodiment, as illustrated in FIG. 10, in a seventh period t7, the $(k-1)^{th}$ carry signal CSk−1 having the gate low voltage is applied to the start terminal ST, and the clock signal CLK having the gate high voltage is applied to the clock terminal CT. As illustrated in FIG. 17, in the seventh period t7, since the first node control transistor NC1 of the $k^{th}$ stage STAk is turned on, the first node N1 is discharged to have the gate low voltage for the seventh period t7.

In the case in which the first node N1 has the gate low voltage, the first transistor T1 of the first inverter INV1 is turned on. Therefore, the second node N2 may be charged to have the gate high voltage.

In the case in which the second node N2 has the gate high voltage, the fourth transistor T4 of the second inverter INV2 is turned on. Therefore, the output terminal OUT may be charged to have the gate low voltage. Accordingly, in the seventh period t7, the $k^{th}$ emission signal EMk having the gate low voltage may be output to the output terminal OUT.

In the case in which the second node N2 has the gate high voltage, the sixth transistor T6 of the third inverter INV3 is turned on. Therefore, the carry signal terminal COUT may be charged to have the gate low voltage. Accordingly, in the seventh period t7, the $k^{th}$ carry signal CSk having the gate low voltage may be output to the carry signal terminal COUT.

In such an embodiment, since an operation of the $(k+1)^{th}$ stage STAk+1 is substantially the same as the operation of the $k^{th}$ stage STAk except that the second node control transistor NC2 of the node controller NC is turned on by the clock signal CLK having the gate low voltage to apply a start signal or the $(k-1)^{th}$ carry signal to the first node N1, any repetitive detailed description of the operation of the $(k+1)^{th}$ stage STAk+1 will be omitted.

According to an embodiment, as illustrated in FIGS. 10 and 11 to 17, the capacitor C is connected to the first node N1, the first node N1 maintains the gate low voltage from the third period t3 to the sixth period t6 in one frame period and maintains the gate high voltage for the remaining periods. Therefore, since the first node N1 connected to the capacitor C is charged once and discharged once for one frame period, an increase in power consumption due to repeated charging and discharging of the first node N1 may be minimized.

Figure 18:
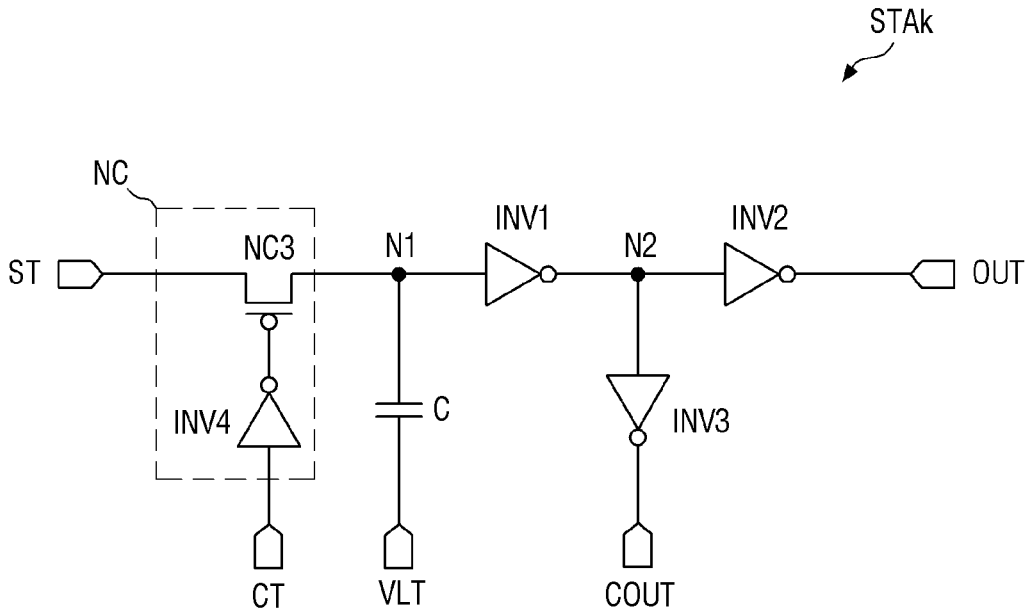
FIG. 18 is a view illustrating an alternative embodiment of a $k^{th}$ stage of an emission signal driver.
Figure 19:
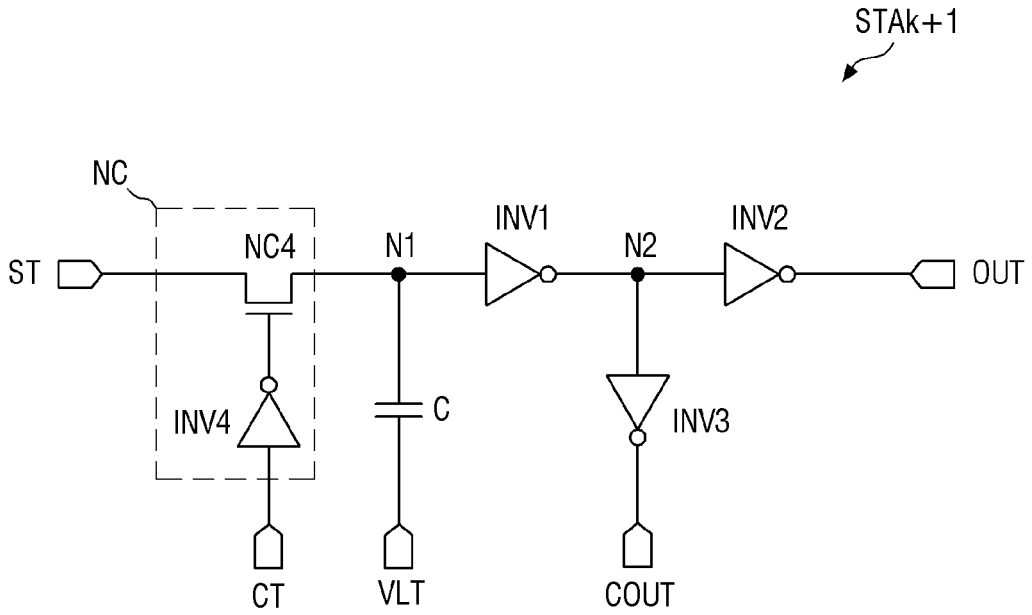
FIG. 19 is a view illustrating an alternative embodiment of a $(k+1)^{th}$ stage of the emission signal driver.
Figure 20:
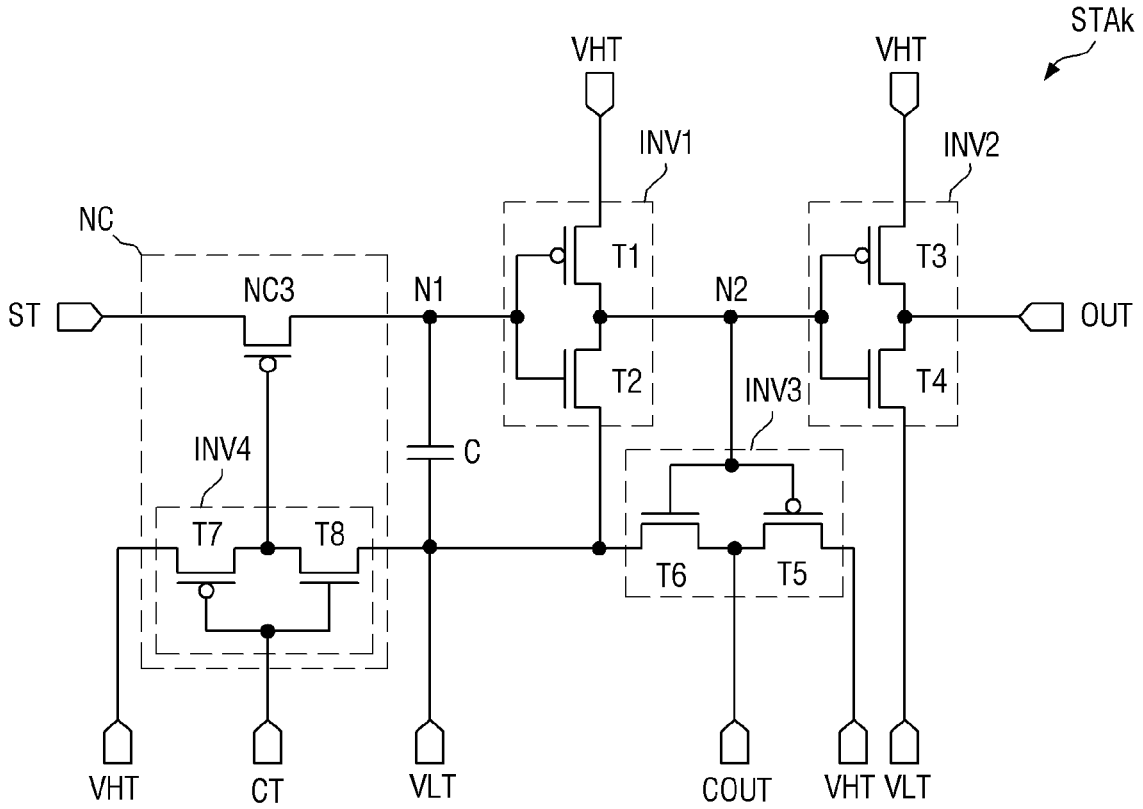
FIG. 20 is a circuit diagram illustrating an embodiment of the $k^{th}$ stage of FIG. 18
Figure 21:
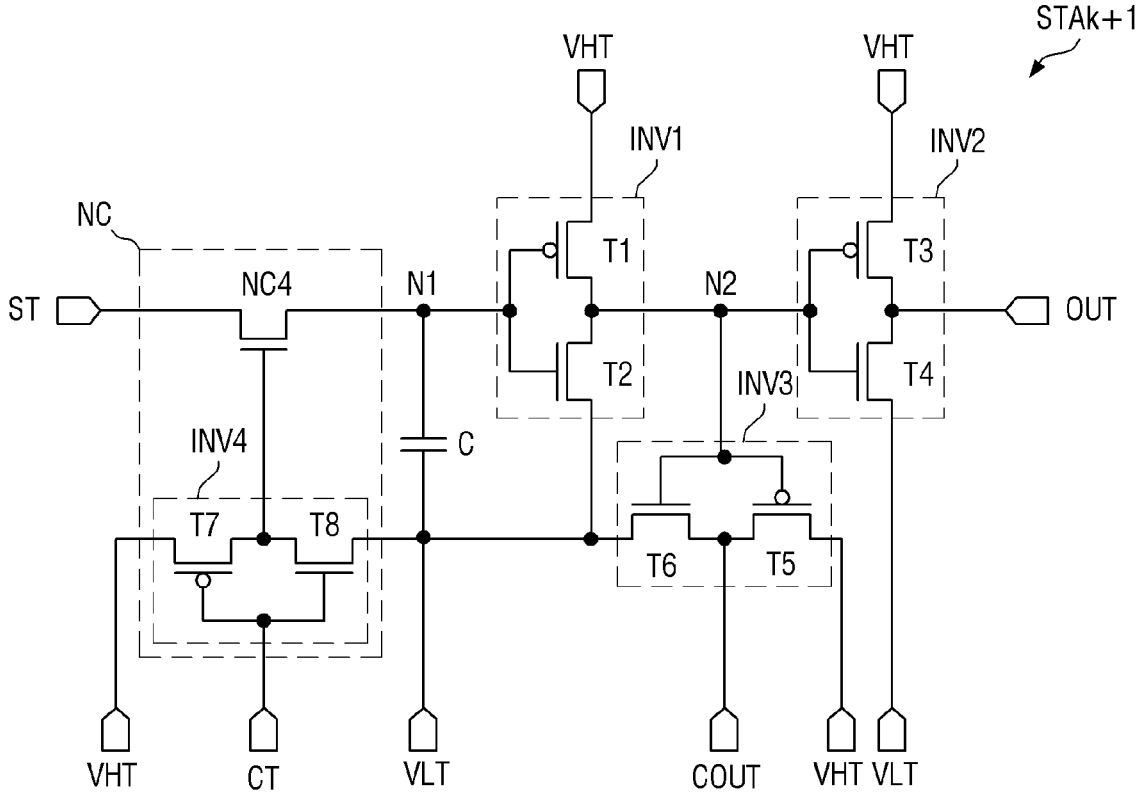
FIG. 21 is a circuit diagram illustrating an embodiment of the $(k+1)^{th}$ stage of FIG. 19.

FIG. 18 is a view illustrating an alternative embodiment of a $k^{th}$ stage of an emission signal driver. FIG. 19 is a view illustrating an alternative embodiment of a $(k+1)^{th}$ stage of the emission signal driver. FIG. 20 is a circuit diagram illustrating an embodiment of the $k^{th}$ stage of FIG. 18. FIG. 21 is a circuit diagram illustrating an embodiment of the $(k+1)^{th}$ stage of FIG. 19;

The embodiment illustrated in FIGS. 18 to 21 is substantially the same as the embodiment illustrated in FIGS. 6 to 9 except that a fourth inverter INV4 is connected between a node controller NC and a clock terminal CT in each of a $k^{th}$ stage STAk and a $(k+1)^{th}$ stage STAk+1, the node controller NC of the $k^{th}$ stage STAk includes a first node control transistor (hereinafter, will be referred to as a third node control transistor) NC3, and the node controller NC of the $(k+1)^{th}$ stage STAk includes a second node control transistor (hereinafter, will be referred to as a fourth node control transistor) NC4. Any repetitive detailed description of the same or like element of FIGS. 18 to 21 as those described above with reference to FIGS. 6 to 9 will be omitted.

In an embodiment, as illustrated in FIGS. 20 and 21, first, third and fifth transistors T1, T3 and T5, and the third node control transistor NC3 may be P-type semiconductors, and second, fourth and sixth transistors T2, T4 and T6 and the fourth node control transistor NC4 may be N-type transistors.

Referring to FIGS. 18 to 21, the node controller NC of each of the $k^{th}$ stage STAk and the $(k+1)^{th}$ stage STAk+1 is connected between a start terminal ST and a first node N1. The node controller NC of the $k^{th}$ stage STAk may apply a start signal or a carry signal input to the start terminal ST to the first node N1 in response to a clock signal input to the clock terminal CT.

The node controller NC of the $k^{th}$ stage STAk may include the third node control transistor NC3. The third node control transistor NC3 may be turned on in a case in which the clock signal having a gate low voltage is applied thereto and may apply the start signal or $(k-1)^{th}$ carry signal to the first node N1. A gate electrode of the third node control transistor NC3 may be connected to the fourth inverter INV4, a first electrode of the third node control transistor NC3 may be connected to the start terminal ST, and a second electrode of the third node control transistor NC3 may be connected to the first node N1.

The node controller NC of the $(k+1)^{th}$ stage STAk+1 may include the fourth node control transistor NC4. The fourth node control transistor NC4 may be turned on in a case in which the clock signal having a gate high voltage is applied thereto and may apply a start signal or $k^{th}$ carry signal to the first node N1. A gate electrode of the fourth node control transistor NC4 may be connected to the fourth inverter INV4, a first electrode of the fourth node control transistor NC4 may be connected to the first node N1, and a second electrode of the fourth node control transistor NC4 may be connected to the start terminal ST.

The fourth inverter INV4 is connected between the node controller NC and the clock terminal CT. The fourth inverter INV4 of the $k^{th}$ stage STAk may be connected between the gate electrode of the third node control transistor NC3 and the clock terminal CT. The fourth inverter INV4 of the $(k+1)^{th}$ stage STAk+1 may be connected between the gate electrode of the fourth node control transistor NC4 and the clock terminal CT. The fourth inverter INV4 may invert a clock signal CLK input to the clock terminal CT and apply the inverted clock signal CLK to the node controller NC. The fourth inverter INV4 may include a seventh transistor T7 and an eighth transistor T8. The seventh transistor T7 may be referred to as a first transistor of the fourth inverter INV4, and the eighth transistor T8 may be referred to as a second transistor of the fourth inverter INV4.

The seventh transistor T7 may be turned on in a case in which the clock signal CLK has the gate low voltage and may apply the gate high voltage to the node controller NC. A gate electrode of the seventh transistor T7 may be connected to the clock terminal CT, a first electrode of the seventh transistor T7 may be connected to a gate high voltage terminal VHT, and a second electrode of the seventh transistor T7 may be connected to the node controller NC.

The eighth transistor T8 may be turned on in a case in which the clock signal CLK has the gate high voltage and may apply the gate low voltage to the node controller NC. A gate electrode of the eighth transistor T8 may be connected to the clock terminal CT, a first electrode of the eighth transistor T8 may be connected to a gate low voltage terminal VLT, and a second electrode of the eighth transistor T8 may be connected to the node controller NC.

Since an operation of the $k^{th}$ stage STAk illustrated in FIGS. 18 to 21 is substantially the same as the operation of the $k^{th}$ stage STAk illustrated in FIGS. 11 to 17, any repetitive detailed description of the operation of the $k^{th}$ stage STAk illustrated in FIGS. 18 to 21 will be omitted.

Figure 22:
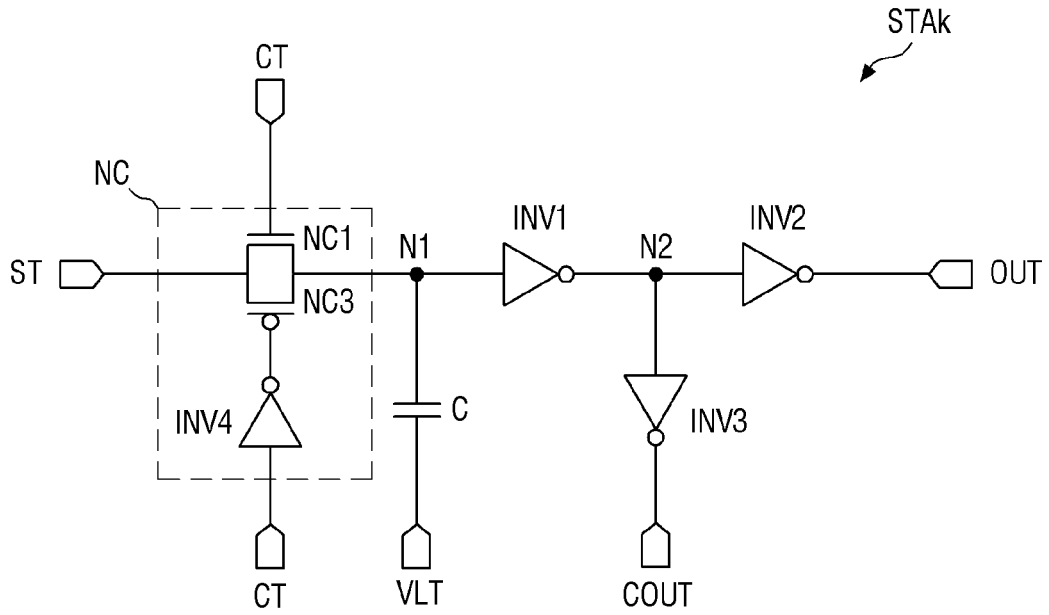
FIG. 22 is a view illustrating another alternative embodiment of a $k^{th}$ stage of an emission signal driver.
Figure 23:
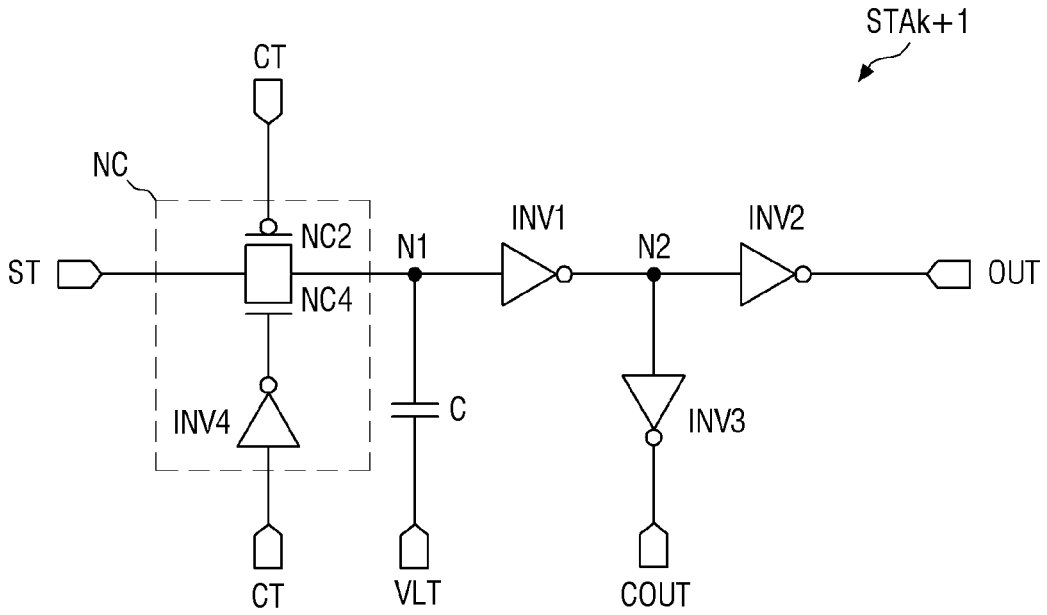
FIG. 23 is a view illustrating another alternative embodiment of a $(k+1)^{th}$ stage of an emission signal driver.
Figure 24:
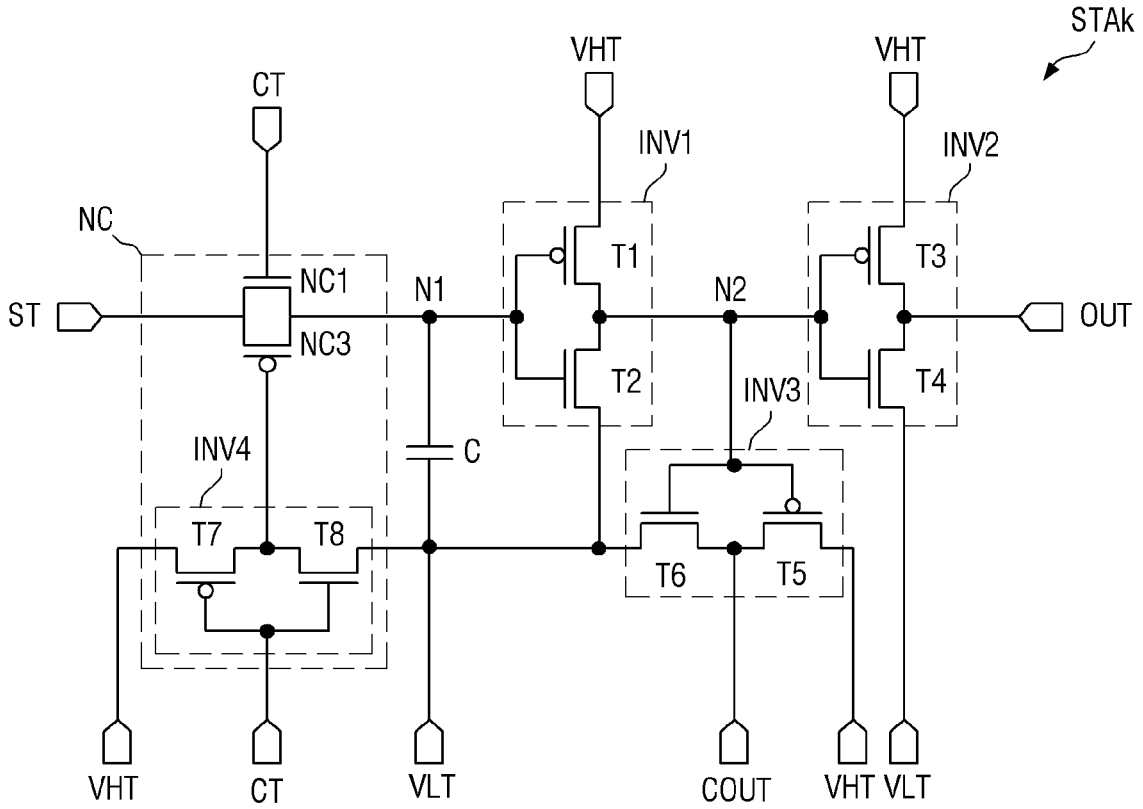
FIG. 24 is a circuit diagram illustrating an embodiment of the $k^{th}$ stage of FIG. 22.
Figure 25:
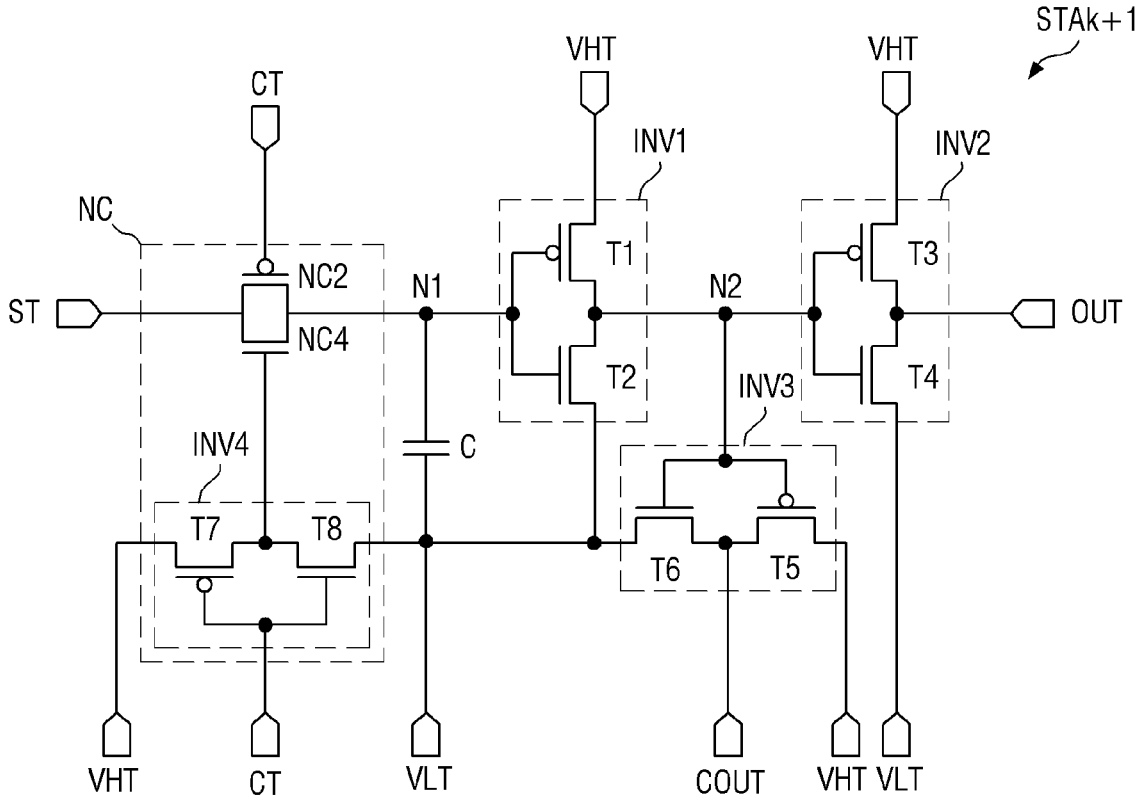
FIG. 25 is a circuit diagram illustrating an embodiment of the $(k+1)^{th}$ stage of FIG. 23.

FIG. 22 is a view illustrating another alternative embodiment of a $k^{th}$ stage of an emission signal driver. FIG. 23 is a view illustrating another alternative embodiment of a $(k+1)^{th}$ stage of an emission signal driver. FIG. 24 is a circuit diagram illustrating an embodiment of the $k^{th}$ stage of FIG. 22. FIG. 25 is a circuit diagram illustrating an embodiment of the $(k+1)^{th}$ stage of FIG. 23.

The embodiment illustrated in FIGS. 22 to 25 is substantially the same as the embodiment illustrated in FIGS. 18 to 21 except that the node controller NC of the $k^{th}$ stage STAk is formed as a transmission gate including the first node control transistor NC illustrated in FIG. 8 and the third node control transistor NC3 illustrated in FIG. 20, and a node controller NC of the $(k+1)^{th}$ stage STAk+1 is formed as a transmission gate including a second node control transistor NC2 illustrated in FIG. 9 and the fourth node control transistor NC4 illustrated in FIG. 21. Therefore, any repetitive detailed description of the same or like elements of the embodiment illustrated in FIGS. 22 to 25 as those described above with reference to FIGS. 18 to 21 will be omitted.

In embodiments of an emission signal driver and a display device including the emission signal driver according to the invention, stages of an emission signal driver are connected to a same clock line as each other and receive a same clock signal as each other. Therefore, the number of the clock lines connected to the stages of the emission signal driver may be reduced. Accordingly, an area of the emission signal driver may be reduced, such that a non-display area of the display panel may be reduced.

In embodiments of the emission signal driver and the display device including the emission signal driver according to the invention, a capacitor of each of the stages of the emission signal driver is connected to a first node, a gate high voltage and a gate low voltage may be output to each of output terminals without bootstrapping. Therefore, in such embodiment, increases in a gate-source voltage and a drain-source voltage of each of transistors connected to the output terminals of the stages of the emission signal driver may be effectively prevented, such that reliability of the transistors connected to the output terminals may be improved.

In embodiments of the emission signal driver and the display device including the emission signal driver according to the invention, the capacitor is connected to the first node, the gate low voltage of the first node is maintained for a predetermined period during one frame period, and the gate high voltage is maintained for the remaining period except for the predetermined period. Therefore, the first node connected to the capacitor is charged once and discharged once during one frame period, such that an increase in power consumption due to repeated charging and discharging of the first node can be minimized.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to exemplary embodiments thereof, it will be understood by those of ordinary skill in the art that various changes in form and details may be made therein without departing from the spirit or scope of the invention as defined by the following claims.

What is claimed is:

1. An emission signal driver comprising stages connected to emission lines, wherein each of the stages includes:

a node controller which supplies a start signal or a carry signal, which is input to a start terminal, to a first node in response to a clock signal input to a clock terminal;

a first inverter connected between the first node and a second node; and a second inverter connected between the second node and an output terminal, and wherein the node controller of a $k^{th}$ stage among the stages includes a first node control transistor which supplies the start signal or the carry signal to the first node in a case in which the clock signal has a gate high voltage, wherein k is a positive integer.

2. The emission signal driver of claim 1, wherein the first inverter includes:

a first transistor which supplies a gate high voltage to the second node in a case in which the first node has a gate low voltage; and a second transistor which supplies the gate low voltage to the second node in a case in which the first node has the gate high voltage.

3. The emission signal driver of claim 2, wherein:

a gate electrode of the first transistor is connected to the first node, a first electrode of the first transistor is connected to a gate high voltage line through which the gate high voltage is supplied, a second electrode of the first transistor is connected to the second node; and a gate electrode of the second transistor is connected to the first node, a first electrode of the second transistor is connected to a gate low voltage line through which the gate low voltage is supplied, and a second electrode of the second transistor is connected to the second node.

4. The emission signal driver of claim 1, wherein the second inverter includes:

a third transistor which supplies a gate high voltage to the output terminal in a case in which the second node has a gate low voltage; and a fourth transistor which supplies the gate low voltage to the output terminal in a case in which the second node has the gate high voltage.

5. The emission signal driver of claim 4, wherein:

a gate electrode of the third transistor is connected to the second node, a first electrode of the third transistor is connected to a gate high voltage line through which the gate high voltage is supplied, a second electrode of the third transistor is connected to the output terminal; and a gate electrode of the fourth transistor is connected to the second node, a first electrode of the fourth transistor is connected to a gate low voltage line through which the gate low voltage is supplied, and a second electrode of the fourth transistor is connected to the output terminal.

6. The emission signal driver of claim 1, wherein each of the stages includes a third inverter connected between the second node and a carry signal terminal.

7. The emission signal driver of claim 6, wherein the third inverter includes:

a fifth transistor which supplies a gate high voltage to the carry signal terminal in a case in which the second node has a gate low voltage; and a sixth transistor which supplies the gate low voltage to the carry signal terminal in a case in which the second node has the gate high voltage.

8. The emission signal driver of claim 7, wherein:

a gate electrode of the fifth transistor is connected to the second node, a first electrode of the fifth transistor is connected to a gate high voltage line through which the gate high voltage is supplied, a second electrode of the fifth transistor is connected to the carry signal terminal; and a gate electrode of the sixth transistor is connected to the second node, a first electrode of the sixth transistor is connected to a gate low voltage line through which the gate low voltage is supplied, and a second electrode of the sixth transistor is connected to the carry signal terminal.

9. The emission signal driver of claim 2, wherein each of the stages includes a capacitor connected between the first node and a first driving voltage line.

10. The emission signal driver of claim 1, wherein a gate electrode of the first node control transistor is connected to the clock terminal, a first electrode of the first node control transistor is connected to the first node, and a second electrode of the first node control transistor is connected to the start terminal.

11. The emission signal driver of claim 1, wherein the node controller of the $(k+1)^{th}$ stage among the stages includes a second node control transistor which supplies the start signal or the carry signal to the first node in a case in which the clock signal has a gate low voltage.

12. The emission signal driver of claim 11, wherein a gate electrode of the second node control transistor is connected to the clock terminal, a first electrode of the second node control transistor is connected to the start terminal, and a second electrode of the second node control transistor is connected to the first node.

13. An emission signal driver comprising stages connected to emission lines, wherein each of the stages includes:

a node controller which supplies a start signal or a carry signal, which is input to a start terminal, to a first node in response to a clock signal input to a clock terminal;

a first inverter connected between the first node and a second node; and a second inverter connected between the second node and an output terminal, and wherein the node controller of a $k^{th}$ stage among the stages includes a third node control transistor which supplies the start signal or the carry signal to the first node in a case in which the clock signal has a gate low voltage, wherein k is a positive integer.

14. The emission signal driver of claim 13, wherein the $k^{th}$ stage further includes a fourth inverter connected between the gate electrode of the third node control transistor and the clock terminal.

15. The emission signal driver of claim 14, wherein a gate electrode of the third node control transistor is connected to a fourth inverter, a first electrode of the third node control transistor is connected to the start terminal, and a second electrode of the third node control transistor is connected to the first node.

16. The emission signal driver of claim 15, wherein the fourth inverter includes:

a seventh transistor which supplies a gate high voltage to the gate electrode of the third node control transistor in the case in which the clock signal has the gate low voltage; and an eighth transistor which supplies the gate low voltage to the gate electrode of the third node control transistor in a case in which the clock signal has the gate high voltage.

17. The emission signal driver of claim 16, wherein a gate electrode of the seventh transistor is connected to the clock terminal, a first electrode of the seventh transistor is connected to a gate high voltage line through which the gate high voltage is supplied, a second electrode of the seventh transistor is connected to the gate electrode of the first node control transistor, a gate electrode of the eighth transistor is connected to the clock terminal, a first electrode of the eighth transistor is connected to a gate low voltage line through which the gate low voltage is supplied, and a second electrode of the eighth transistor is connected to the gate electrode of the third node control transistor.

18. The emission signal driver of claim 13, wherein the node controller of the $(k+1)^{th}$ stage among the stages includes a fourth node control transistor which supplies the start signal or the carry signal to the first node in a case in which the clock signal has a gate high voltage.

19. A display device comprising:

pixels connected to emission lines; and an emission signal driver including stages connected to the emission lines, wherein each of the stages includes a node controller which supplies a start signal or a carry signal, which is input to a start terminal, to a first node in response to a clock signal input to a clock terminal, a first inverter connected between the first node and a second node, and a second inverter connected between the second node and an output terminal, and wherein the node controller of a kth stage among the stages includes a node control transistor which supplies the start signal or the carry signal to the first node in a case in which the clock signal has a gate high voltage or a gate low voltage, wherein k is a positive integer.

* * * * *